US007891983B2

(12) United States Patent
Ichimura et al.

(10) Patent No.: US 7,891,983 B2
(45) Date of Patent: Feb. 22, 2011

(54) CONTACT AND IC SOCKET USING THE SAME

(75) Inventors: Yoshiaki Ichimura, Akiruno (JP); Masafumi Aoki, Tokyo (JP)

(73) Assignee: Yamaichi Electronics Co., Ltd., Tokyo (JP)

( * ) Notice: Subject to any disclaimer, the term of this patent is extended or adjusted under 35 U.S.C. 154(b) by 16 days.

(21) Appl. No.: 12/511,820

(22) Filed: Jul. 29, 2009

(65) Prior Publication Data

US 2010/0029100 A1 Feb. 4, 2010

(30) Foreign Application Priority Data

Jul. 31, 2008 (JP) ..... 2008-197824
May 19, 2009 (JP) ..... 2009-121182

(51) Int. Cl.
*H01R 12/00* (2006.01)

(52) U.S. Cl. ..... 439/66

(58) Field of Classification Search ..... 439/66
See application file for complete search history.

(56) References Cited

U.S. PATENT DOCUMENTS 5,324,205 A * 6/1994 Ahmad et al. ..... 439/66
2009/0075497 A1* 3/2009 Swart et al. ..... 439/66
2010/0029100 A1* 2/2010 Ichimura et al. ..... 439/66

FOREIGN PATENT DOCUMENTS

JP 2002-231401 8/2002
JP 2003-123924 4/2003
JP 2003-163045 6/2003
JP 2008-21459 1/2008

OTHER PUBLICATIONS

Official Notice of Rejection dated Jun. 11, 2010 in corresponding Japanese Patent Application No. 2009-121182, 7 pages total.

* cited by examiner

*Primary Examiner*—Ross N Gushi
(74) *Attorney, Agent, or Firm*—Finnegan, Henderson, Farabow, Garrett & Dunner, LLP

(57) ABSTRACT

A contact, above and below which two contact objects are present, comprises a first arm portion having a first contact portion at a tip end thereof, a first arcuate projection, a coupling portion, a second arcuate projection, and a second arm portion having a second contact portion at a tip end thereof. In the contact, the first arm portion and the coupling portion are connected to each other with the first arcuate projection therebetween to assume a substantially V-shaped configuration. The coupling portion and the second arm portion are connected to each other with the second arcuate projection therebetween to assume a substantially V-shaped configuration. The first arcuate projection is disposed below the first arm portion and outside an extension of the first arm portion. The second arcuate projection is disposed above the second arm portion and outside an extension n of the second arm portion.

21 Claims, 24 Drawing Sheets

CONTACT AND IC SOCKET USING THE SAME

CROSS-REFERENCE TO RELATED APPLICATIONS

This application claims the benefit of Japanese Patent Application Nos. 2008-197824 filed Jul. 31, 2008, and Nos. 2009-121182 filed May 19, 2009 which are hereby incorporated by reference herein in their entirety.

BACKGROUND OF THE INVENTION

1. Field of the Invention

The present invention relates to a contact and an IC socket using the same, and more particular, to a contact, above and below which two contact objects are present, and an IC socket using such contact.

2. Description of the Related Art

Conventionally, a contact, above and below which two contact objects (for example, above which an IC package is present and below which a printed circuit board is present) are present, disclosed in Japanese Patent Laid-Open No. 2008-21459 is used as a contact for an IC socket mounting thereon a semiconductor package (referred to as an "IC package" from now on) for high-frequency wave application and serving as testing. Such contact is structured to contact elastically with both an IC package mounted on an IC socket and a printed circuit board such as a test board to thereby enable electric connection between the IC package and the printed circuit board. Such contact is also contrived to shorten a length of a signal line of an electric current (signal), which flows through the contact, with a view to accommodating for high-frequency wave signals, and to achieve a decrease in inductance.

In recent years, it is demanded to make such contact small in size as an IC package mounted on an IC socket and external contacts of a printed circuit board are made small in pitch. Accordingly, although a contact is made small in size, a contrivance for an increase in resilience of a contact is made as shown in Japanese Patent Laid-Open No. 2008-21459 in order to accomplish a stable electric connection to two contact objects such as an IC package mounted on an IC socket and a printed circuit board.

It is an object of the invention to achieve a further improvement in resilience for a contact even when the contact is the same in size and to increase the magnitude of elastic deformation of contact portions of a contact, which contact electrically with external contacts of two contact objects, for a contact and an IC socket using the same. More specifically, it is an object of the invention to increase a distance, over which contact portions of a contact project from a socket body of an IC socket mounting thereon the contact. Thereby, it is possible to prevent nonuniformity in electric contact between contact portions of a contact and external contacts, which is generated by warping of an IC package mounted on an IC socket and a printed circuit board. Consequently, even when warping exists in an IC package and a printed circuit board, which constitute contact objects, a further stable, electric contact can be obtained by a contact according to the invention and and an IC socket using the same.

It is an object of the invention to provide a contact, which is prevented from coming off an IC socket, and in which contact forces with contact objects, such as an IC package and a printed circuit board, above and below the contact are made the same, and IC socket using such contact.

SUMMARY OF THE INVENTION

In order to attain the object, the invention provides a contact, which is substantially Z-shaped as viewed laterally, and above and below which two contact objects are present, and which comprises a first flat arm portion having a first contact portion at a tip end thereof, a first arcuate projection, a flat coupling portion, a second arcuate projection, and a second flat arm portion having a second contact portion at a tip end thereof, and wherein the first arm portion and the coupling portion are folded back with the first arcuate projection therebetween and are connected to each other to assume a substantially V-shaped configuration, the coupling portion and the second arm portion are folded back with the second arcuate projection therebetween and are connected to each other to assume a substantially V-shaped configuration, the first arcuate projection is disposed below the first arm portion and outside an extension of the first arm portion, and the second arcuate projection is disposed above the second arm portion and outside an extension n of the second arm portion.

Also, with the contact according to the invention, preferably, the first and second arm portions are provided with turned-up pieces, in which free ends thereof are cut and turned up toward the coupling portion, respectively.

Further, with the contact according to the invention, preferably, the first and second arcuate projections are arranged to be point-symmetrical with respect to a center axis of the contact.

Further, with the contact according to the invention, preferably, a center of curvature of a circle of curvature of the first arcuate projection is disposed outside the extension of the first arm portion, and a center of curvature of a circle of curvature of the second arcuate projection is disposed outside the extension of the second arm portion.

Also, an IC socket according to the invention has a feature in comprising at least a socket body having a plurality of contact accommodating chambers, each of which accommodates therein the contact according to any one of above contacts, and mounting thereto two contact objects, which contact with the first and second contact portions of the contact, and in that the contact accommodating chambers extend through the socket body up and down.

Further, with the IC socket according to the invention, preferably, a pair of side walls opposed to each other to define the contact accommodating chamber provided on the socket body are formed obliquely and parallel to each other, horizontal step portions are formed midway the respective side walls to be different in height from a bottom surface of the socket body from each other and in parallel to the bottom surface, and the horizontal step portions support the arcuate projections of the contact.

The contact according to the invention is substantially Z-shaped as viewed laterally and comprises two arcuate projection corresponding to two arm portions each having a contact portion at a tip end thereof, so that it is possible to increase magnitudes, over which the contact portions of the contact project from the socket body of the IC socket, to which the contact is mounted, so that it is possible to increase magnitude of elastic deformation of the contact portions whereby even when warping exists in an IC package and a printed circuit board, which constitute contact objects, a further stable, electric contact can be obtained by a contact according to the invention and an IC socket using the same.

Also, by providing the turned-up pieces on each of the two arm portions, it is possible to shorten a signal line passing through the contact, so that it is possible to provide a contact being preferable for high speed transmission.

Further, since those parts, which constitute the contact, are arranged to be point-symmetrical with respect to a center axis of the contact, the contact is uniform in deformation, so that the contact is deformed stably and can be surely and be readily mounted to an IC socket.

Also, centers of curvature of circles of curvature of the first and second arcuate projections are disposed outside the extensions of the corresponding, first and second arm portions, whereby the contact can be further stably and so further surely mounted in a contact accommodating chamber of an IC socket.

By mounting the contact according to the invention in a contact accommodating chamber formed to extend through a socket body, which constitutes an IC socket, the IC socket according to the invention can connect two contact objects to each other surely and electrically.

Further, the contact according to the invention is mounted obliquely in the contact accommodating chamber and the two arcuate projections of the contact are supported on the horizontal step portions, which are different in height from each other, whereby the IC socket according to the invention can accommodate for that situation, in which two contact objects are made small in pitch, and the contact is supported on two inclined walls and the two horizontal step portions, whereby the contact is not changed in posture within the contact accommodating chamber, the contact can be held surely and stably, and the contact can be elastically deformed stably.

Further features of the present invention will become apparent from the following description of exemplary embodiments (with reference to the attached drawings).

DESCRIPTION OF EMBODIMENTS

Several preferred embodiments according to the invention will be described below with reference to the drawings First, referring to FIGS. 1 to 8, an explanation will be given to contacts and IC sockets, which use the same, according to two fundamental embodiments of the invention.

Figure 1:
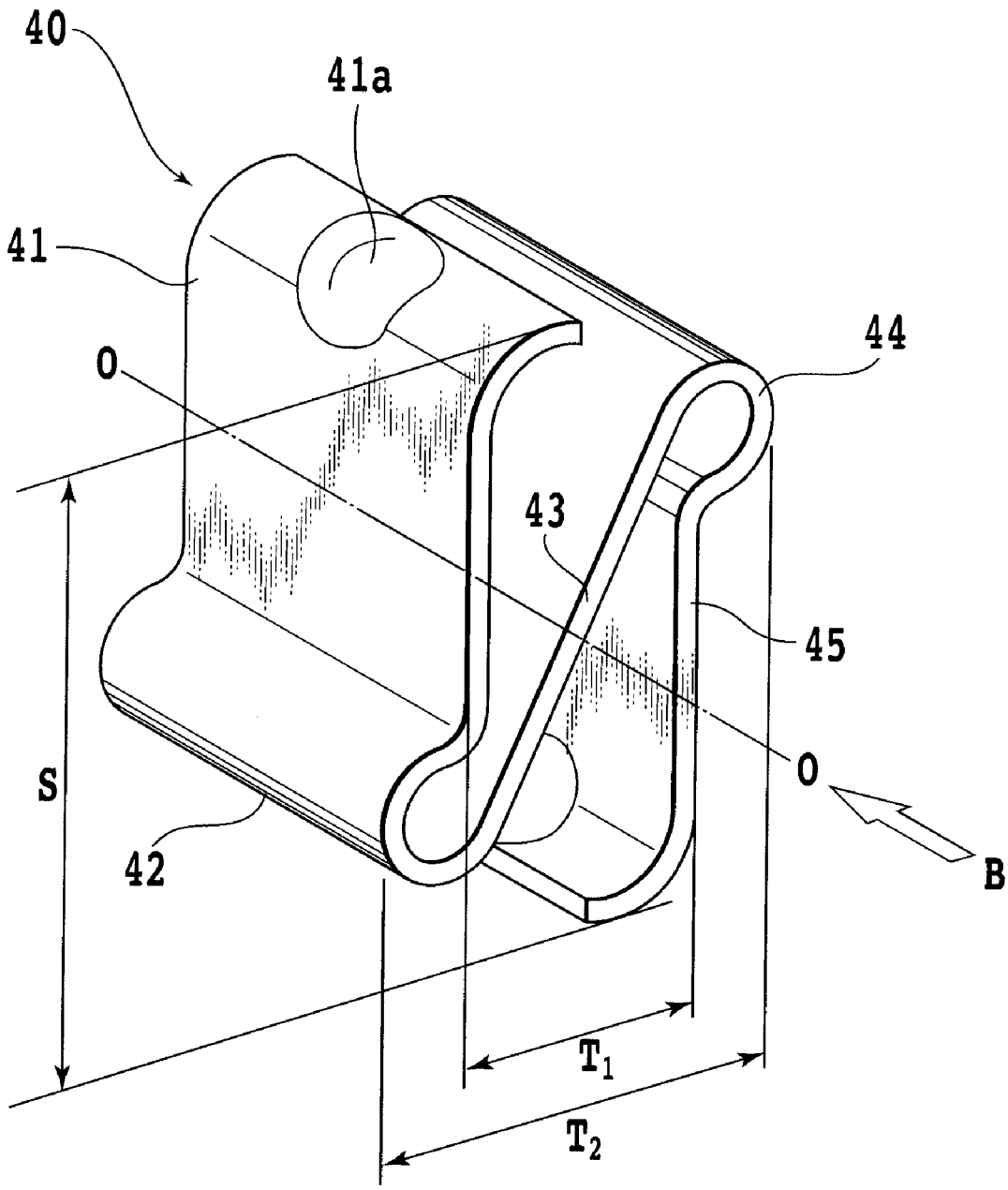
FIG. 1 is a perspective view showing a contact according to an embodiment of the invention.
Figure 2:
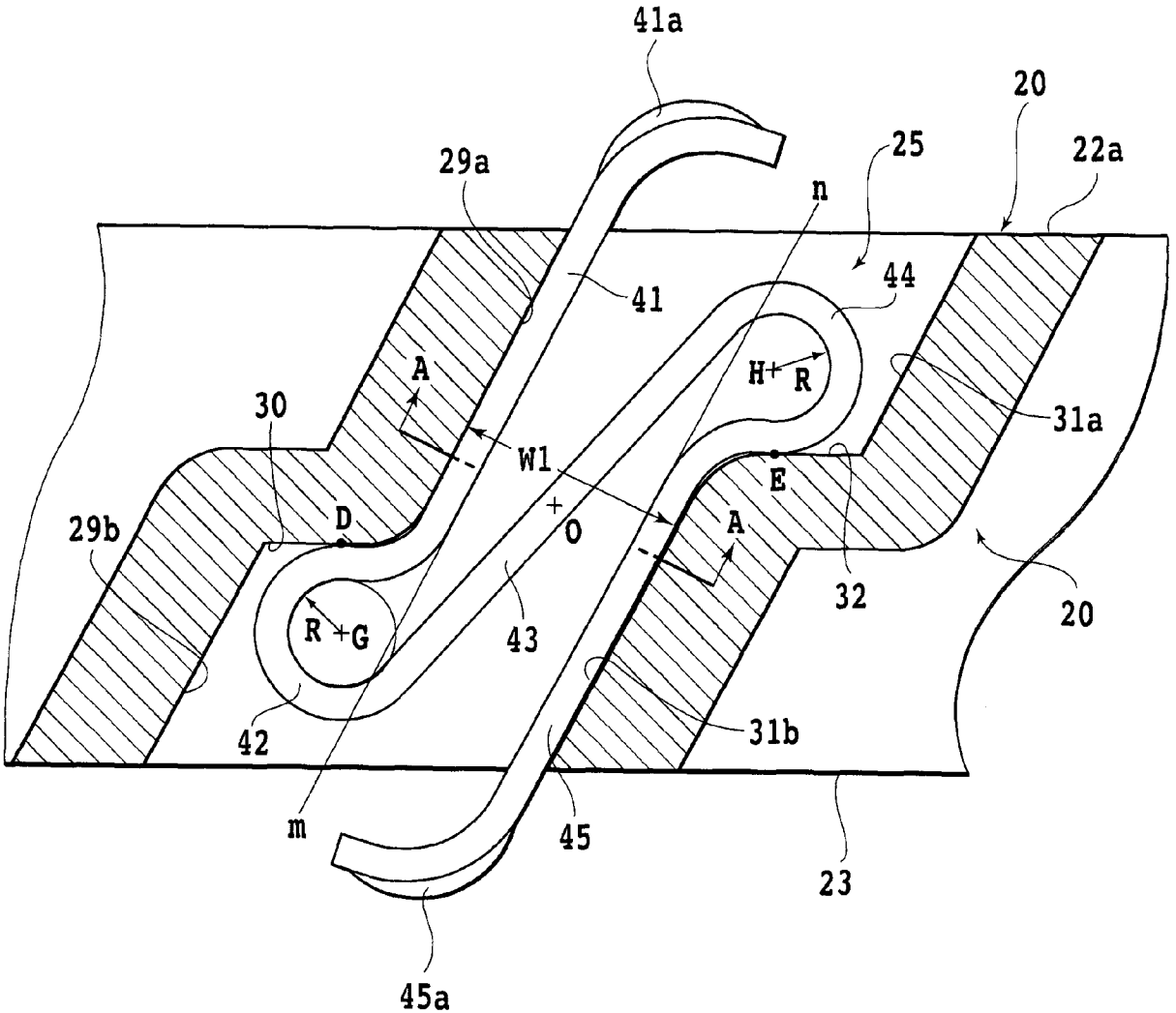
FIG. 2 is a partially cross sectional view showing a state, in which the contact shown in FIG. 1 is mounted to a socket body of an IC socket and two contact objects are not mounted.
Figure 3:
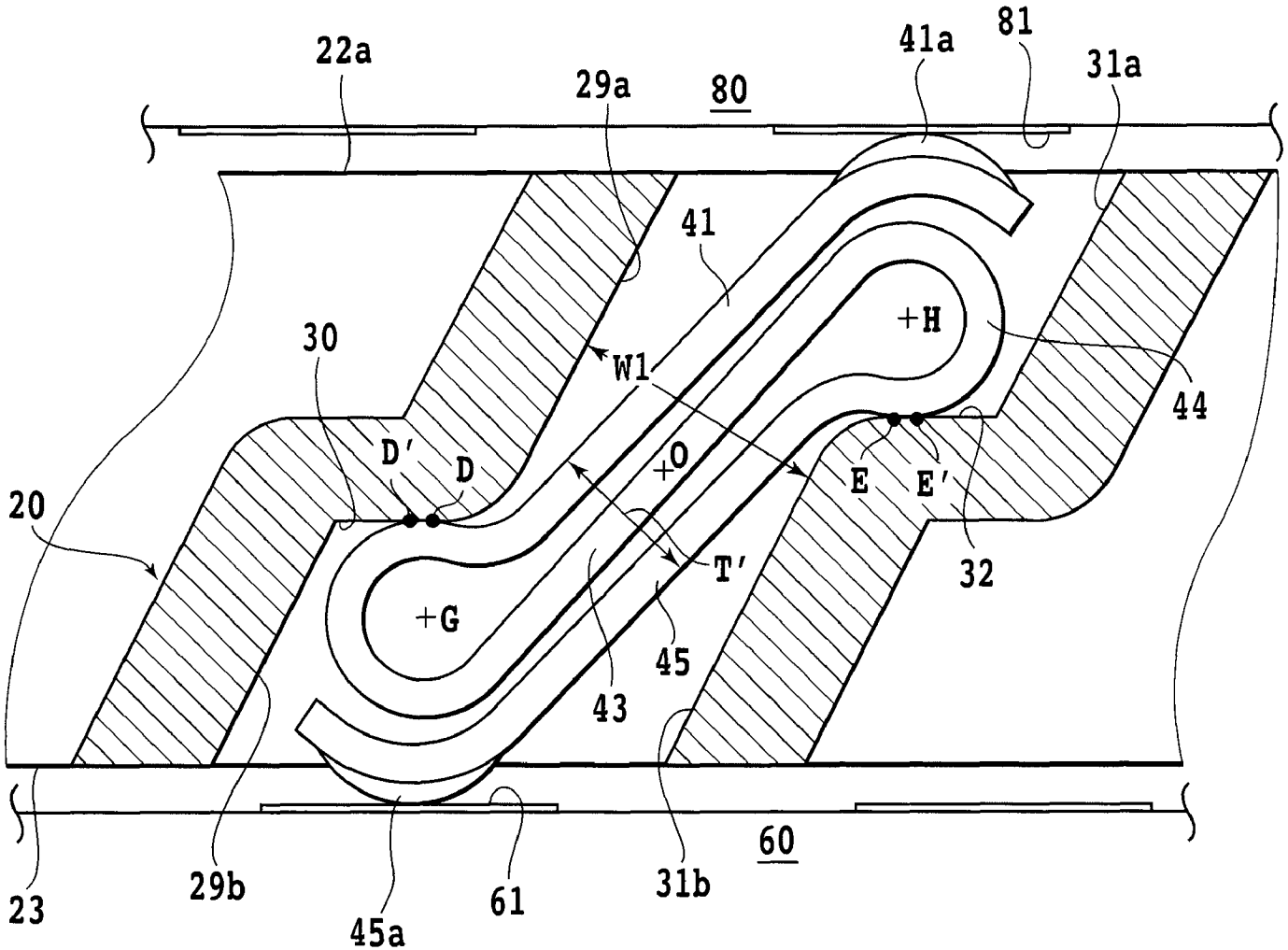
FIG. 3 is a partially cross sectional view being similar to FIG. 2 and showing a state, in which two contact objects are mounted to the IC socket and the contact shown in FIG. 1 contacts electrically with the two contact objects.
Figure 4:
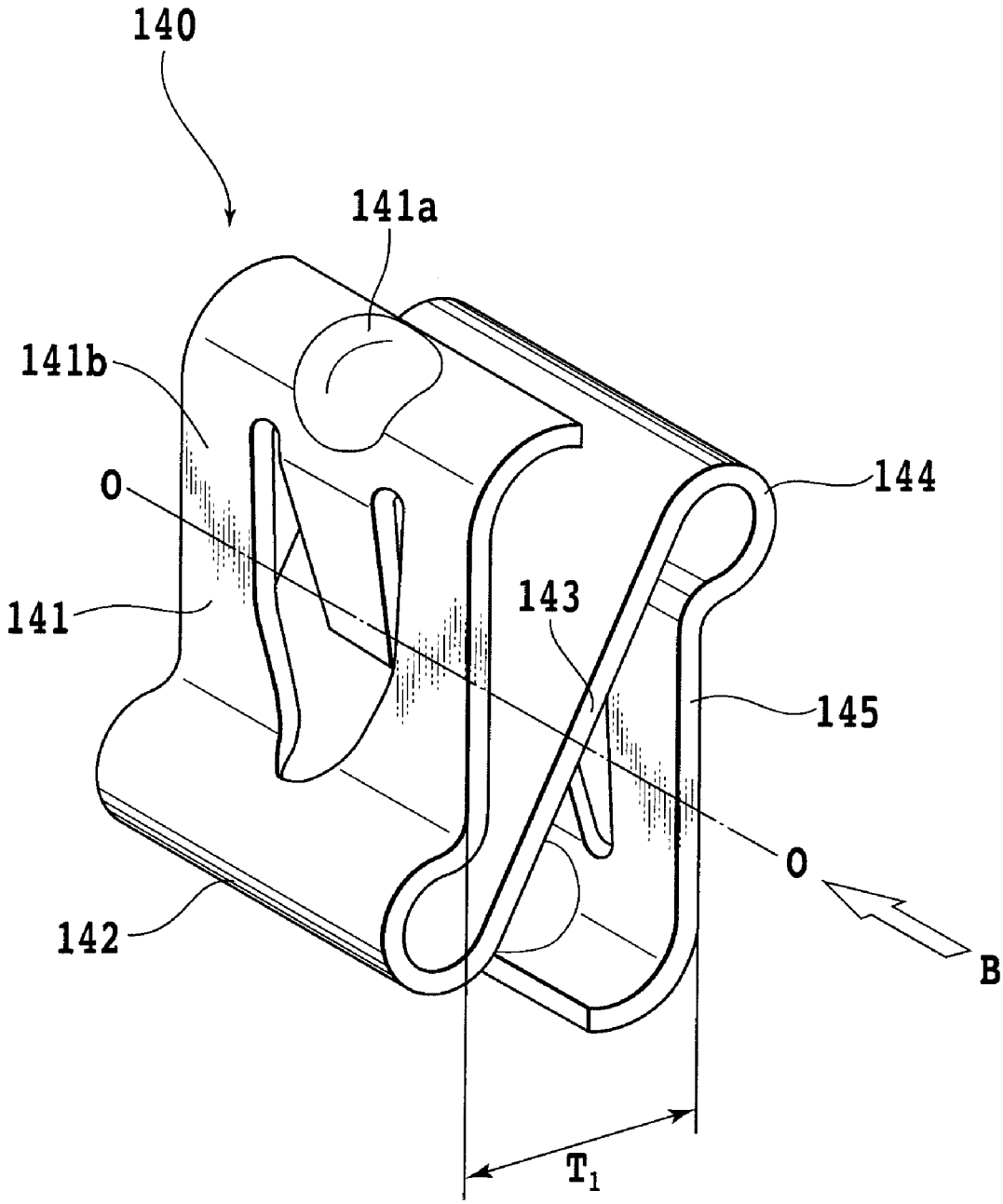
FIG. 4 is a perspective view showing a contact according to a further embodiment of the invention.
Figure 5:
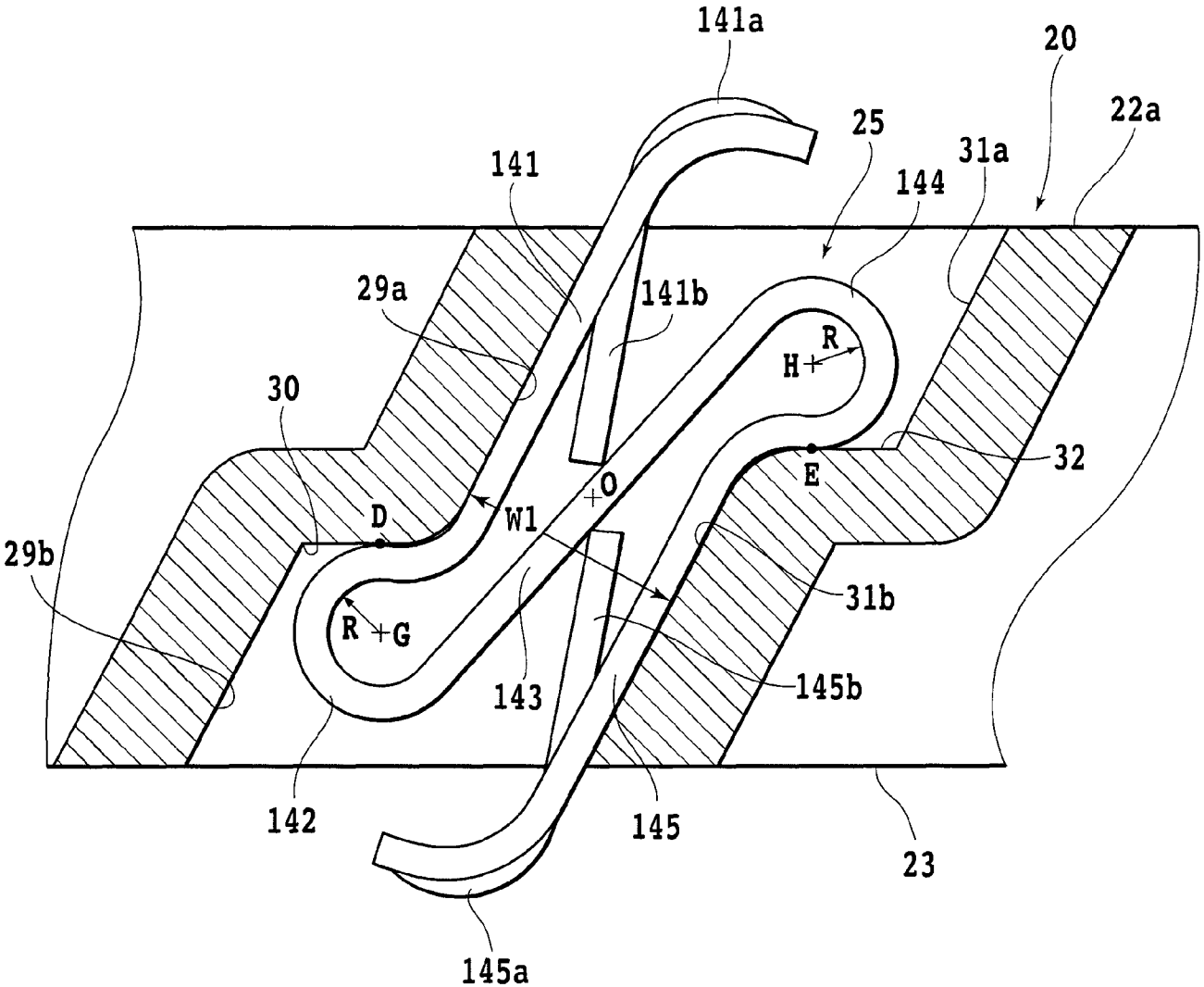
FIG. 5 is a partially cross sectional view showing a state, in which the contact shown in FIG. 4 is mounted to a socket body of an IC socket and two contact objects are not mounted.
Figure 6:
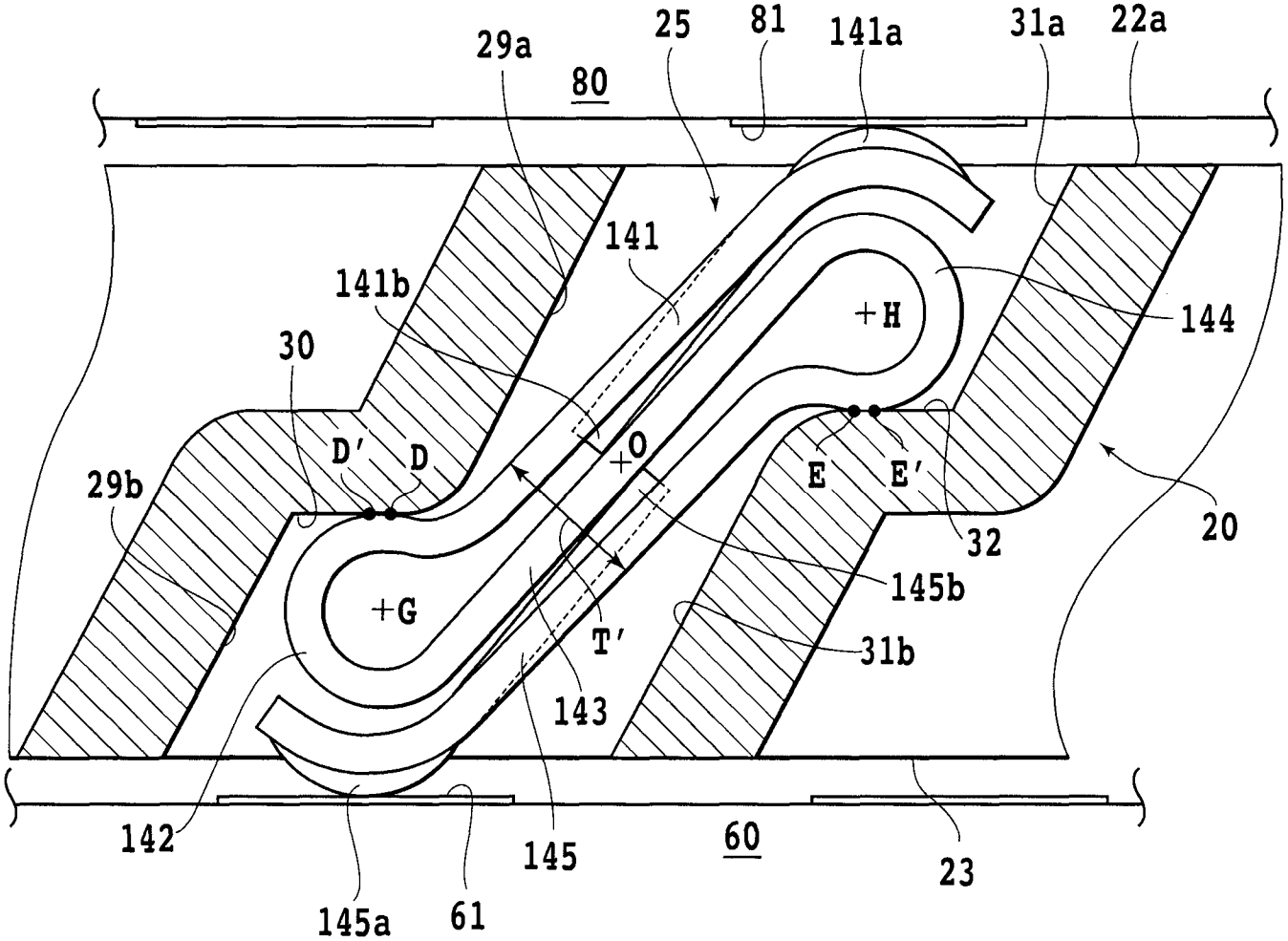
FIG. 6 is a partially cross sectional view being similar to FIG. 5 and showing a state, in which two contact objects are mounted to an IC socket and the contact shown in FIG. 4 contacts electrically with the two contact objects.
Figure 7:
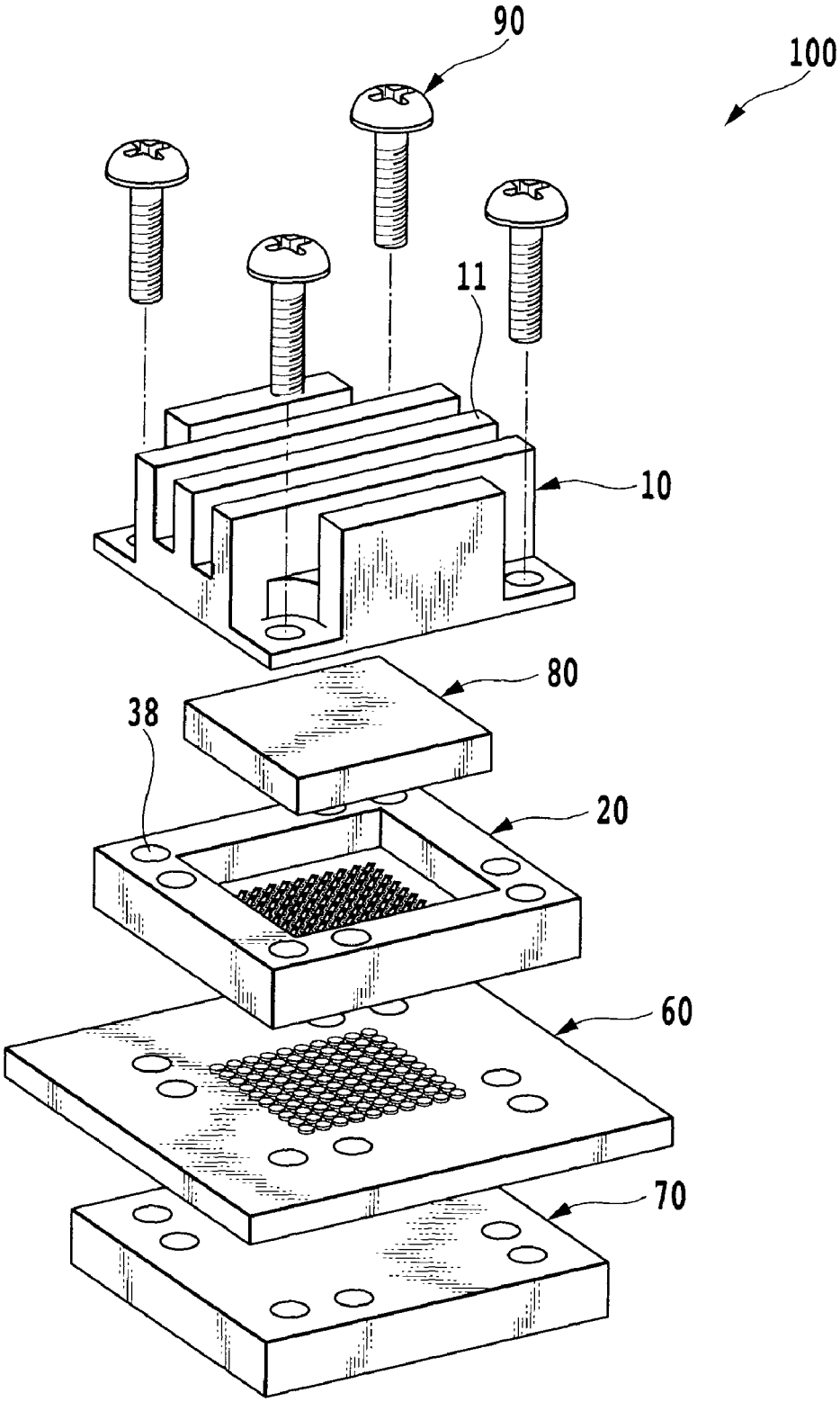
FIG. 7 is a schematic, exploded, perspective view showing an IC socket making use of a contact according to the invention.

FIG. 1 is a perspective view showing a contact according to a first embodiment of the invention and FIG. 2 is a partially cross sectional view showing a state, in which the contact shown in FIG. 1 is mounted to a socket body of an IC socket and two contact objects are not mounted. FIG. 3 is a partially cross sectional view being similar to FIG. 2 and showing a state, in which two contact objects are mounted to the IC socket and the contact shown in FIG. 1 contacts electrically with the two contact objects. FIG. 4 is a perspective view showing a contact according to a second embodiment of the invention and FIG. 5 is a partially cross sectional view showing a state, in which the contact shown in FIG. 4 is mounted to a socket body of an IC socket and two contact objects are not mounted. FIG. 6 is a partially cross sectional view being similar to FIG. 5 and showing a state, in which two contact objects are mounted to an IC socket and the contact shown in FIG. 4 contacts electrically with the two contact objects. FIG. 7 is a schematic, exploded, perspective view showing an IC socket making use of a contact according to the invention and FIG. 8 is a schematic, exploded, perspective view showing the IC socket shown in FIG. 7.

First, an IC socket, for which a contact, having two contact objects, according to the invention is used, will be described with reference to FIGS. 7 and 8.

Figure 8:
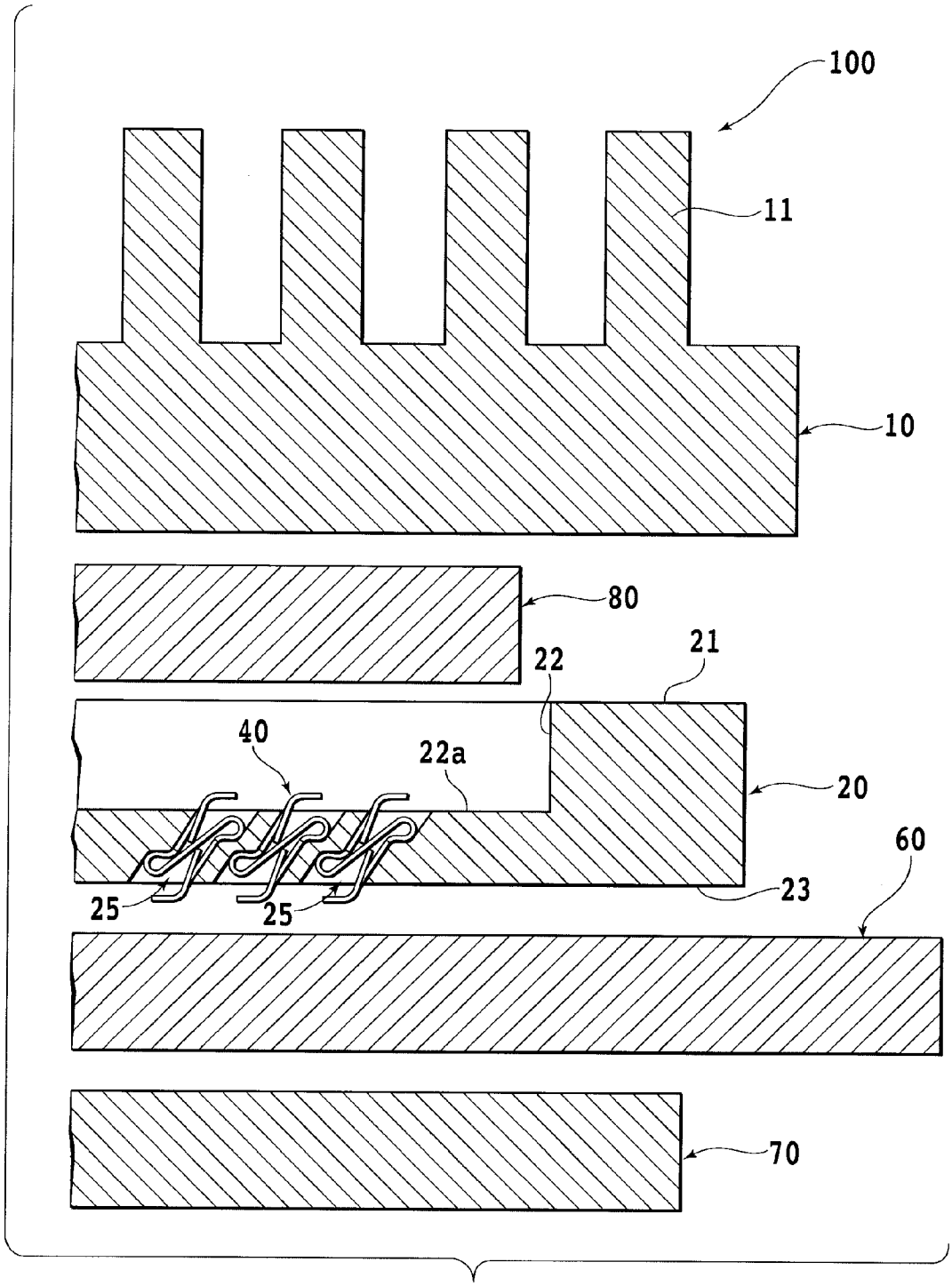
FIG. 8 is a schematic, exploded, perspective view showing the IC socket shown in FIG. 7.

As shown in FIGS. 7 and 8, an IC socket 100 substantially comprises a socket body 20 and a push member 10. The IC socket 100 is fixed directly to a printed circuit board 60, or a base member 70 through the printed circuit board 60 by means of fixation means 90 such as screws or the like.

The push member 10 pushes an IC package 80, which is mounted on the IC socket 100, toward contacts 40 (or 140) from above. In the embodiment, an underside of the push member 10 is formed as a push part that pushes the IC package 80. As shown in FIGS. 7 and 8, the push member 10 preferably comprises a heat sink 11 for heat diffusion.

Arranged on the socket body 20 are a plurality of contacts 40 (or 140) for electrical connection between the IC package 80 and the printed circuit board 60. The socket body 20 is formed from an electrically insulating synthetic resin such as liquid crystal polymer and polyethersulfone to assume a hexahedron being substantially square-shaped as viewed from above. A contour of the socket body 20 includes an upper surface 21, a bottom surface 23 in parallel to the upper surface 21, and four side surfaces being perpendicular to the surfaces 21, 23 to connect the surfaces 21, 23.

Formed substantially centrally of the upper surface 21 of the socket body 20 is a recess 22, on which an IC package is placed and which is bottomed and substantially square-shaped as viewed from above. In the embodiment, the recess 22 for IC package placement includes four side surfaces being perpendicular to the upper surface 21 of the socket body 20 and a bottom surface 22*a* being in parallel to the upper surface 21 of the socket body 20 and substantially rectangular-shaped in horizontal section. The bottom surface 22*a* defines a surface, on which the IC package 80 is placed. In addition, a surface, on which the IC package 80 is placed, may be formed by providing placement members at four corners or on four sides of the bottom surface 22*a* being substantially rectangular-shaped in horizontal section. Mount holes 38, through which the fixation means 90 can pass when the socket body 20 is to be fixed to, for example, the printed circuit board 60, are formed at four corners of the socket body 20 to extend through the socket body 20.

A plurality of contact accommodating chambers 25 for accommodation of the plurality of contacts 40 (or 140) are arrayed in a matrix manner on the bottom surface 22*a* of the recess 22 for IC package placement to correspond to contact pads 81 (FIGS. 3 and 6) serving as external contacts of the IC package 80. As shown in FIG. 8, the contacts 40 (or 140) are accommodated one by one in the respective contact accommodating chambers 25 to be oriented in the same direction.

As shown in FIGS. 2, 3, 5, and 6, the contact accommodating chambers 25 extend through the socket body 20 to be directed toward the bottom surface 23 of the socket body 20 from the bottom surface 22*a* of the recess 22 for IC package placement. Preferably, the contact accommodating chambers 25 extend through the socket body 20 so as to be inclined at an angle of about 45° to the bottom surface 22*a* of the recess 22 for IC package placement. With such construction, resin portions between the adjoining contact accommodating chambers 25 can have a larger wall thickness than that in case of extending perpendicularly to the bottom surface 22*a*. Thereby, an improvement is achieved in voltage endurance between the respective contacts 40 (or 140) and the socket body 20 is easily molded. In addition, as far as being allowable in design, a narrow pitch can be accommodated for by decreasing (thinning) a wall thickness of resin portions between the adjoining contact accommodating chambers 25. Also, the contact accommodating chambers 25 in the embodiment are formed so as to be inclined at an angle of about 45° to the bottom surface 22*a* of the recess 22 for IC package placement but this is not limitative. For example, as far as being allowable in design, the contact accommodating chambers 25 may be inclined at an appropriate angle to the bottom surface 22*a* or may extend substantially perpendicularly to the bottom surface 22*a*.

The structure of the contact accommodating chambers 25 will be described with reference to FIGS. 2, 3, 5, and 6. As described above, the contact accommodating chambers 25 fundamentally extend through the socket body 20 so as to be inclined at an angle of about 45° to the bottom surface 22*a* of the recess 22 for IC package placement (or the bottom surface 23 of the socket body 20) as IC package placement surface. More specifically, the contact accommodating chamber 25 is square-shaped as viewed in a direction along a sectional line A-A shown in FIG. 2, so that the contact accommodating chamber 25 is defined by four side walls. Side walls opposed to each other on the left and right in FIG. 2, respectively, out of the four side walls include a first upper inclined side wall 29*a*, a first lower inclined side wall 29*b*, a second upper inclined side wall 31*a*, and a second lower inclined side wall 31*b*.

The first upper inclined side wall 29*a* and the first lower inclined side wall 29*b* are parallel to each other and inclined at an angle of about 45° to the bottom surface 22*a* of the recess 22 for IC package placement and the bottom surface 23 of the socket body 20. Also, a first horizontal step portion 30 is provided between the first upper inclined side wall 29*a* and the first lower inclined side wall 29*b*. The first horizontal step portion 30 is parallel to the bottom surface 22*a* of the recess 22 for IC package placement or the bottom surface 23 of the socket body 20 to support a first arcuate projection 42 (or 142), described later, of the contact 40 (or 140).

Likewise, the second upper inclined side wall 31*a* and the second lower inclined side wall 31*b* are also parallel to each other and inclined at an angle of about 45° to the bottom surface 22*a* of the recess 22 for IC package placement and the bottom surface 23 of the socket body 20. Accordingly, all the first upper inclined side wall 29*a*, the first lower inclined side wall 29*b*, the second upper inclined side wall 31*a*, and the second lower inclined side wall 31*b* are formed to be parallel to one another. Also, a second horizontal step portion 32 is provided between the second upper inclined side wall 31*a* and the second lower inclined side wall 31*b*. Like the first horizontal step portion 30, the second horizontal step portion 32 is parallel to the bottom surface 22*a* of the recess 22 for IC package placement or the bottom surface 23 of the socket body 20 to support a second arcuate projection 44 (or 144), described later, of the contact 40 (or 140). In the embodiment, the first horizontal step portion 30 is formed below the second horizontal step portion 32. In other words, the first horizontal step portion 30 is formed in a position being lower in a height from the bottom surface 23 of the socket body 20 than the second horizontal step portion 32. Also, the first upper inclined side wall 29*a* and the second lower inclined side wall 31*b*, which are parallel to each other, are formed so that a distance W1 therebetween is made smaller than a distance T1 between a first arm portion 41 and a second arm portion 45, which are parallel to each other, of the contact 40 (or 140) put in a free state.

In FIG. 2, the remaining two side walls opposed to each other in front and in rear relative to the plane of the figure are perpendicular to all the first upper inclined side wall 29*a*, the first lower inclined side wall 29*b*, the second upper inclined side wall 31*a*, the second lower inclined side wall 31*b*, and the bottom surface 22*a* of the recess 22 for IC package placement.

By forming the contact accommodating chambers 25 in this manner, first and second contact portions 41*a*, 45*a*, described later, of the contact 40 can be arranged to project up and down as shown in the figure without interference with four side walls, which define the contact accommodating chamber 25. Also, the contact accommodating chamber 25 can mount the contact 40 in a manner to incline the same in the contact accommodating chamber 25 and the two horizontal step portions 30, 32 having different heights from the bottom surface 23 of the socket body 20 can support the two corresponding arcuate projections 42, 44, respectively. Thereby, the contact 40 can be surely and stably held in the contact accommodating chamber 25 without a change in posture even when any external force is applied thereto. Further, the first and second arm portions 41, 45 of the contact 40 can be elastically deformed stably in the contact accommodating chamber 25. Also, since the horizontal step portions 30, 32 are different in height from each other, the two arcuate projections 42, 44 of the contact 40 as supported are different in height position from each other whereby a coupling portion 43 for connection of the two arcuate projections 42, 44 is arranged to be inclined in the contact accommodating chamber 25. Accordingly, a width required for the contact accommodating chamber 25 can be made smaller than that in the case where the coupling portion 43 is arranged in parallel to the bottom surface 22*a*, so that it is possible to accommodate for that situation, in which external contacts of the IC package 80 are made small in pitch.

First Embodiment

While being not limitative, two fundamental embodiments of a contact are illustrated as shown in FIGS. 1 to 3 and 4 to 6. First, a contact 40 according to a first embodiment will be described with reference to FIGS. 1 to 3.

The contact 40 is punched as an elongate band-shaped body having a predetermined shape from a conductive, metallic sheet such as beryllium copper (BeCu) and formed into a shape, which is contactable up and down with two contact objects as shown in FIG. 1, by bending the band-shaped body. The contact 40 according to the embodiment is substantially Z-shaped as viewed laterally (in a direction indicated by an arrow B in FIG. 1).

The contact 40 according to the embodiment includes a first flat arm portion 41 having a first contact portion 41*a* at a tip end thereof, a first arcuate projection 42, a flat, coupling portion 43, a second arcuate projection 44, and a second flat arm portion 45 having a second contact portion 45*a* at a tip end thereof. The first arm portion 41 and the coupling portion 43 are folded back with the first arcuate projection 42 therebetween, which is arcuate in cross section and has a circle of curvature, of which an inscribing circle has a radius R of curvature, whereby the portions are connected to each other to assume a substantially V-shaped configuration. Further, the coupling portion 43 and the second arm portion 45 are folded back with the second arcuate projection 44 therebetween, which is arcuate in cross section and has a circle of curvature, of which an inscribing circle has a radius R of curvature, whereby the portions are connected to each other to assume a substantially V-shaped configuration.

The first arcuate projection 42 is formed so that a center G of curvature thereof is positioned substantially below the first arm portion 41 and a little outside an extension m of the first arm portion 41 (on the left of the extension m of the first arm portion 41 in FIG. 2) as shown in FIG. 2. Also, the first arcuate projection 42 is formed in a manner to contact with the horizontal step portion 30 at a contact point D disposed on a circle of curvature, which circumscribes the first arcuate projection 42, when the contact 40 is mounted in the contact accommodating chamber 25, as shown in FIG. 2. Accordingly, the first arcuate projection 42 is formed to project toward an outside from the first arm portion 41. In addition, the first arm portion 41 is formed in a manner to be supported on a first upper inclined side wall 29*a* along the first upper inclined side wall 29*a* when the contact 40 is mounted in the contact accommodating chamber 25. The first arm portion 41 and the first arcuate projection 42 are formed in this manner whereby the first arm portion 41 can be elastically deformed about the center G of curvature of the first arcuate projection 42.

Also, the second arcuate projection 44 is formed so that a center H of curvature thereof is positioned substantially above the second arm portion 45 and a little outside an extension n of the second arm portion 45 (on the right of the extension n of the second arm portion 45 in FIG. 2) as shown in FIG. 2. Also, the second arcuate projection 44 is formed in a manner to contact with the horizontal step portion 32 at a contact point E disposed on a circle of curvature, which circumscribes the second arcuate projection 44, when the contact 40 is mounted in the contact accommodating chamber 25, as shown in FIG. 2. Accordingly, the second arcuate projection 44 is formed to project toward an outside from the second arm portion 45. In addition, the second arm portion 45 is formed in a manner to be supported on a second lower inclined side wall 31*b* along the second lower inclined side wall 31*b* when the contact 40 is mounted in the contact accommodating chamber 25. The second arm portion 45 and the second arcuate projection 44 are formed in this manner whereby the second arm portion 45 can be elastically deformed about the center H of curvature of the second arcuate projection 44.

In addition, in the embodiment, the respective centers G, H of curvature of the first and second arcuate projections 42, 44 are set to be disposed a little outside the extensions m, n of the first and second arm portions 41, 45. However, this is not limitative but the centers G, H of curvature may be disposed on or a little inside the extensions m, n. In an arrangement, in which the centers G, H of curvature are disposed a little outside the extensions m, n, release of engagement between the respective arcuate projection 42 or 44 and the corresponding horizontal step portion 30 or 32 is hard to occur when the contact 40 contacts with an IC package 80 and a printed circuit board 60.

The first arm portion 41 and the second arm portion 45 are formed to be made parallel to each other when put in a free state shown in FIG. 1. Also, when put in the free state, a spacing (distance) T1 between the first arm portion 41 and the second arm portion 45, which are formed in parallel to each other, is larger than a spacing W1 between the first upper inclined side wall 29*a* and the second lower inclined side wall 31*b*, which are opposite and parallel to each other, of the contact accommodating chamber 25 as described above.

As shown in FIG. 2, the contact 40 is accommodated in the contact accommodating chamber 25 of the socket body 20. More specifically, since the distance W1 between the inclined side walls of the contact accommodating chamber 25 is smaller than the spacing T1 between the arm portions, the contact 40 put in a state shown in FIG. 1 is elastically deformed in a more flattened configuration and inserted in an inclined state into the contact accommodating chamber 25. The contact 40 inserted into the contact accommodating chamber 25 is caused by a whole spring restoring force to be going to open toward a state shown in FIG. 1 from a flattened configuration within the contact accommodating chamber 25. Therefore, it is to be understood that when mounted in the contact accommodating chamber 25, the contact 40 is supported in four locations, that is, the first upper inclined side wall 29*a*, the first horizontal step portion 30, the second horizontal step portion 32, and the second lower inclined side wall 31*b* as shown in FIG. 2. That is, the first arm portion 41 of the contact 40 is supported on the first upper inclined side wall 29*a*, the first arcuate projection 42 is supported on the first horizontal step portion 30, the second arcuate projection 44 is supported on the second horizontal step portion 32, and the second arm portion 45 is supported on the second lower inclined side wall 31*b*. In other words, the contact 40 is self-held in the contact accommodating chamber 25 by its own spring restoring force.

The first contact portion 41*a* is formed at a tip end of the first arm portion 41 to be upwardly convex and arcuate in shape and the second contact portion 45*a* is formed at a tip end of the second arm portion 45 to be downwardly convex and arcuate in shape. As shown in FIGS. 2 and 3, the first contact portion 41*a* and the second contact portion 45*a*, respectively, can be displaced up and down and left and right in a manner to draw circles about the center G of curvature of the first arcuate projection 42 and the center H of curvature of the second arcuate projection 44. Further, as shown in FIGS. 1 and 2, the first contact portion 41*a* may be formed to project centrally in a width direction of the first arm portion 41 and upwardly of the first arm portion 41. Likewise, the second contact portion 45*a* may be formed to project centrally in a width direction of the second arm portion 45 and downwardly of the second arm portion 45.

With the contact 40 in the embodiment, the first arm portion 41, the first arcuate projection 42, the coupling portion 43, the second arcuate projection 44, and the second arm portion 45 for connection of a first contact portion 42*a* and a second contact portion 44*a* constitute a signal line. While the signal line appears to be apparently lengthy, the signal line amounts to approximately 3 mm not to constitute a marked hindrance to high speed transmission of a signal when it is taken into consideration that the height S of the contact 40 amounts to about 1 mm at the utmost. In addition, the reference numeral T2 denotes a depth of the contact 40 including the first and second arcuate projections 42, 44.

From the above description, it is understood that the two arm portions 41, 45, the two arcuate projections 42, 44, and the coupling portion 43, which constitute the contact 40 of the invention, are arranged to be point-symmetrical with respect to a center axis O-O of the contact 40 passing through the coupling portion 43. This is the same in all states when put in the free state shown in FIG. 1, when accommodated in the contact accommodating chamber 25 as shown in FIG. 2, and when two objects 60, 80 of contact shown in FIG. 3 are mounted to the IC socket 20.

Second Embodiment

Subsequently, a further contact 140 according to a second embodiment of the invention will be described with reference to FIGS. 4 to 6. Like the first embodiment, the contact 140 according to the embodiment is punched as an elongate band-shaped body having a predetermined shape from a conductive, metallic sheet and manufactured by bending the band-shaped body. The contact 140 according to the embodiment is also formed into a shape, which is contactable up and down with two contact objects as shown in FIG. 4, to be substantially Z-shaped as viewed laterally (in a direction indicated by an arrow B in FIG. 4).

Also, the contact 140 according to the embodiment is fundamentally the same in structure as that of the first embodiment. In FIGS. 4 to 6, the same constituent parts as those in the first embodiment are denoted by reference numerals, which are obtained by simply adding 100 to the reference numerals in the latter, the constituent parts acting or functioning in the same manner as in the first embodiment. The contact 140 according to the embodiment and the contact 40 according to the first embodiment are different from each other only in that turned-up pieces 141*b*, 145*b* are provided on a first arm portion 141 and a second arm portion 145 of the contact 140 according to the embodiment.

Like the first embodiment, the contact 140 according to the embodiment includes the first arm portion 141 having a first contact portion 141*a* at a tip end thereof, a first arcuate projection 142, a flat, coupling portion 143, a second arcuate projection 144, and the second arm portion 145 having a second contact portion 145*a* at a tip end thereof. The first arm portion 141 and the coupling portion 143 are folded back with the first arcuate projection 142 therebetween, which is arcuate in cross section and has a radius R of curvature, whereby the portions are formed to assume a substantially V-shaped configuration. Further, the coupling portion 143 and the second arm portion 145 are folded back with the second arcuate projection 144 therebetween, which is arcuate in cross section and has a radius R of curvature, whereby the portions are formed to assume a substantially V-shaped configuration.

In the embodiment, the first turned-up piece 141*b* and the second turned-up piece 145*b* are provided on the first arm portion 141 and the second arm portion 145, respectively. The first turned-up piece 141*b* extends substantially centrally in a width direction of the first arm portion 141 and between the first contact portion 141*a* and the first arcuate projection 142. The first turned-up piece 141*b* is cut out toward the coupling portion 143 so that a side toward the first contact portion 141*a* of the first turned-up piece 141*b* is connected to the first arm portion 141 and a side toward the first arcuate projection 142 thereof is formed as a free end, the free end affording elastic deformation. The second turned-up piece 145*b* extends substantially centrally in a width direction of the second arm portion 145 and between the second contact portion 145*a* and the second arcuate projection 144. The second turned-up piece 145*b* is cut out toward the coupling portion 143 so that a side toward the second contact portion 145*a* of the second turned-up piece 145*b* is connected to the second arm portion 145 and a side toward the second arcuate projection 144 thereof is formed as a free end, the free end affording elastic deformation.

The respective free ends of the first turned-up piece 141*b* and the second turned-up piece 145*b* may be connected to the coupling portion 143 or separated from the coupling portion 143 when the contact 140 is put in a free state shown in FIG. 4. However, lengths of the first turned-up piece 141*b* and the second turned-up piece 145*b* are set so that the respective free ends are elastically deformed to enable contacting with the coupling portion 143 when the first and second contact portions 141*a*, 145*a* contact with two contact objects as shown in FIG. 6.

By providing the first and second turned-up pieces 141*b*, 145*b* on the contact 140, a signal line can be shortened as compared with the first embodiment. That is, in the embodiment, a signal can flow through the first and second turned-up pieces 141*b*, 145*b* and the coupling portion 143 between the first contact portion 141*a* and the second contact portion 145*a*.

Since the remaining structure of the contact 140 according to the embodiment is the same as that of the contact 40 according to the first embodiment, an explanation therefor is omitted.

Subsequently, an explanation will be given to the action of the contact 40 when an IC socket 1 provided with the contact 40 according to the first embodiment is mounted to the printed circuit board 60 and subsequently, an IC package 80 is mounted to the IC socket 1.

As shown in FIG. 3, the contact 40 is accommodated in the contact accommodating chamber 25 of the socket body 20 and then the printed circuit board 60 such as a test board and the IC package 80 are mounted to an IC socket 100. At this time, the first contact portion 41*a* of the contact 40 abuts against the contact pad 81 serving as an external contact of the IC package 80 and is pushed down by the IC package 80. The first arm portion 41 rotates about the center G of curvature of the first arcuate projection 42 and is elastically deformed whereby the first contact portion 41*a* descends elastically. Also, the restoring force of the first arm portion 41 electrically contacts the first contact portion 41*a* and the contact pad 81 of the IC package 80 to each other with a predetermined contact pressure.

In addition, as the first arm portion 41 rotates, the first arcuate projection 42 also rotates clockwise about the center G of curvature and its contact point with the first horizontal step portion 30 shifts to D' from D as shown in FIG. 3. However, the first arcuate projection 42 is still supported on the first horizontal step portion 30.

Likewise, the second contact portion 45*a* of the contact 40 abuts against the contact pad 61 serving as an external contact of the printed circuit board 60 and is pushed up by the printed circuit board 60. The second arm portion 45 rotates about the center H of curvature of the second arcuate projection 44 and is elastically deformed whereby the second contact portion 45*a* ascends elastically. Also, the restoring force of the second arm portion 45 electrically contacts the second contact portion 45*a* and the contact pad 61 of the printed circuit board 60 to each other with a predetermined contact pressure.

In addition, as the second arm portion 45 rotates, the second arcuate projection 44 also rotates clockwise about the center H of curvature and its contact point with the second horizontal step portion 32 shifts to E' from E as shown in FIG. 3. However, the second arcuate projection 44 is still supported on the second horizontal step portion 32. Accordingly, in addition to being supported on the first horizontal step portion 30 of the first arcuate projection 42, the contact 40 is stably held in the contact accommodating chamber 25 in spite of elastic deformation of the first and second arm portions 41, 45.

Also, when being put in a state shown in FIG. 3, the parts constituting the contact 40 are positioned point-symmetrically with respect to the center axis O-O of the contact 40, so that the first arm portion 41 and the second arm portion 45 are maintained parallel to each other and a distance therebetween is decreased to T'.

The contact 140 according to the second embodiment acts in the same manner to contact electrically with the printed circuit board 60 and the IC package 80 with a predetermined contact pressure.

Third Embodiment

Third and fourth embodiments of the invention will be described with reference to FIGS. 9 to 11 and 12 to 14.

It is possible in the first embodiment that the contact 40 comes off downwardly of the contact accommodating chamber 25 provided in the socket body 20. More specifically, when a force is exerted only on the first contact portion 41*a* of the contact 40 from above in FIG. 2, the second arcuate projection 44 of the contact 40 can move leftward. When the force exerted from above increases, a magnitude of movement of the second arcuate projection 44 becomes large, so that it comes off the horizontal step portion 32, which defines the contact accommodating chamber 25, and the second arcuate projection 44 slides down the second lower inclined side wall 31*b*. Also, in the case where a force is exerted only on the second contact portion 45*a* of the contact 40 from under, a similar phenomenon occurs in a point-symmetrical manner and the contact 40 possibly springs upward from the contact accommodating chamber 25.

In the third and fourth embodiments, the contact and the IC socket in the first embodiment are further improved in structure so as to enable completely preventing the contact from coming off the contact accommodating chamber.

Figure 9:
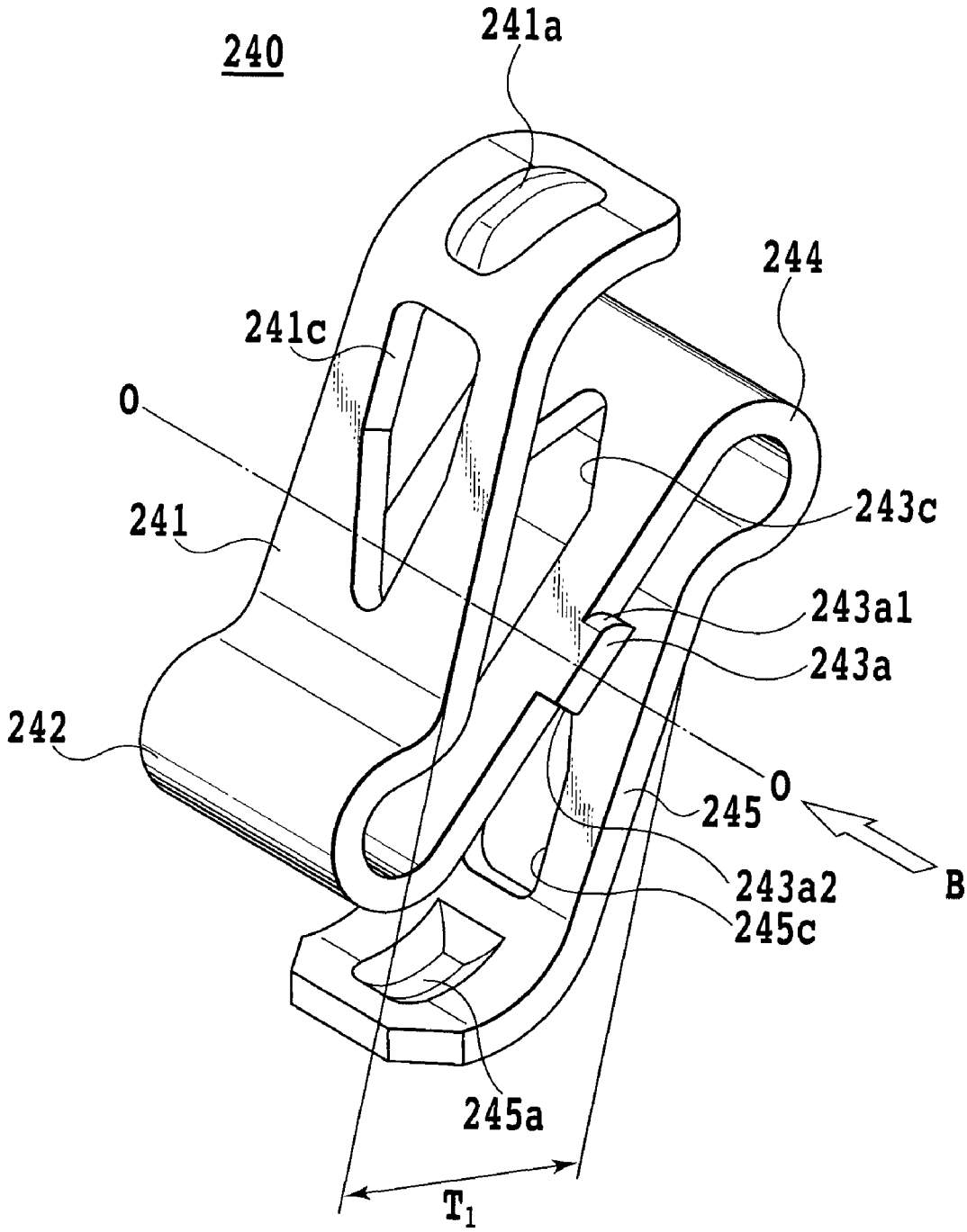
FIG. 9 is a perspective view showing a contact according to a third embodiment of the invention.
Figure 10A:
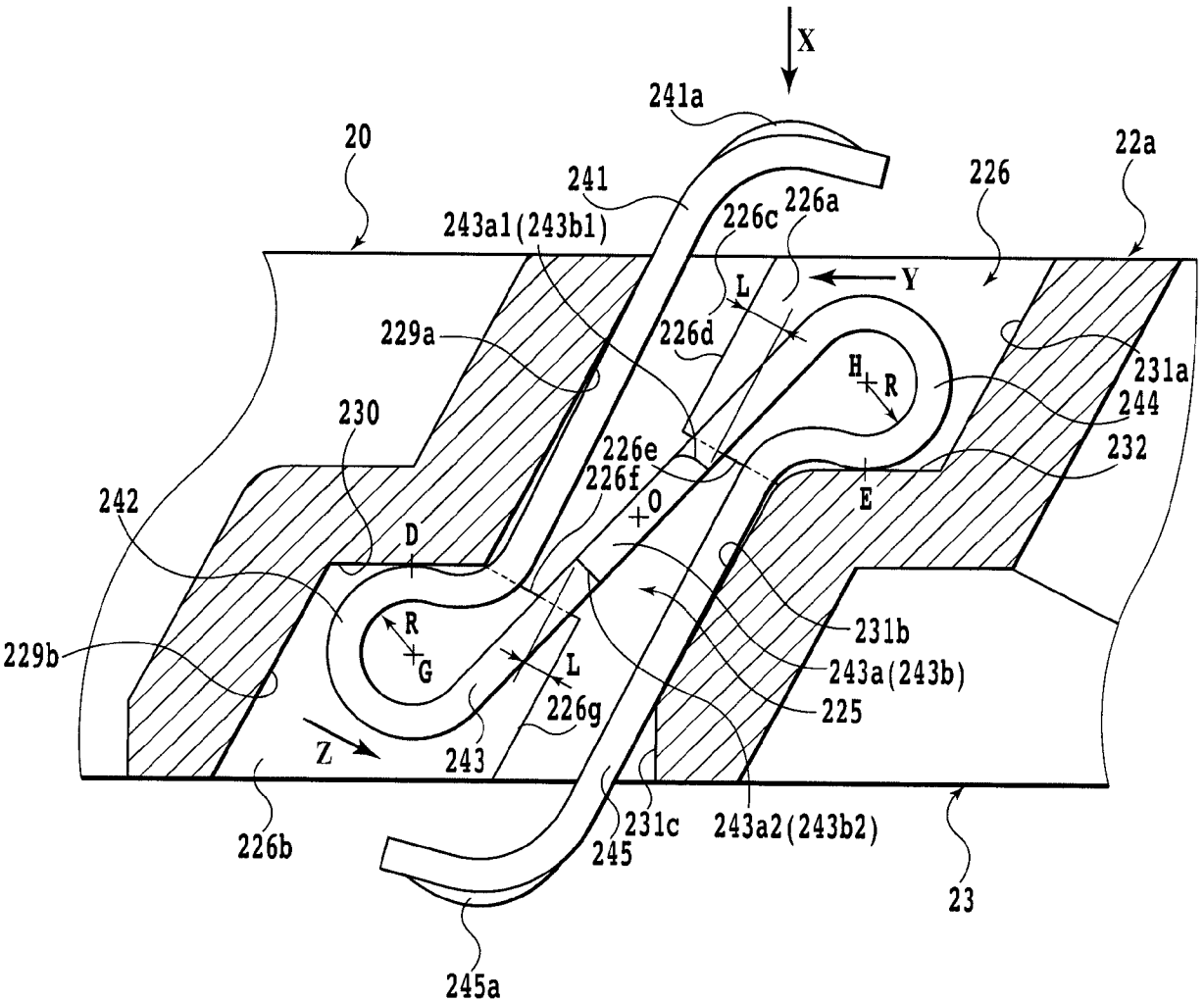
FIG. 10A is a partially cross sectional view showing a state, in which the contact shown in FIG. 9 is mounted to a socket body of an IC socket and two contact objects are not mounted.
Figure 10B:
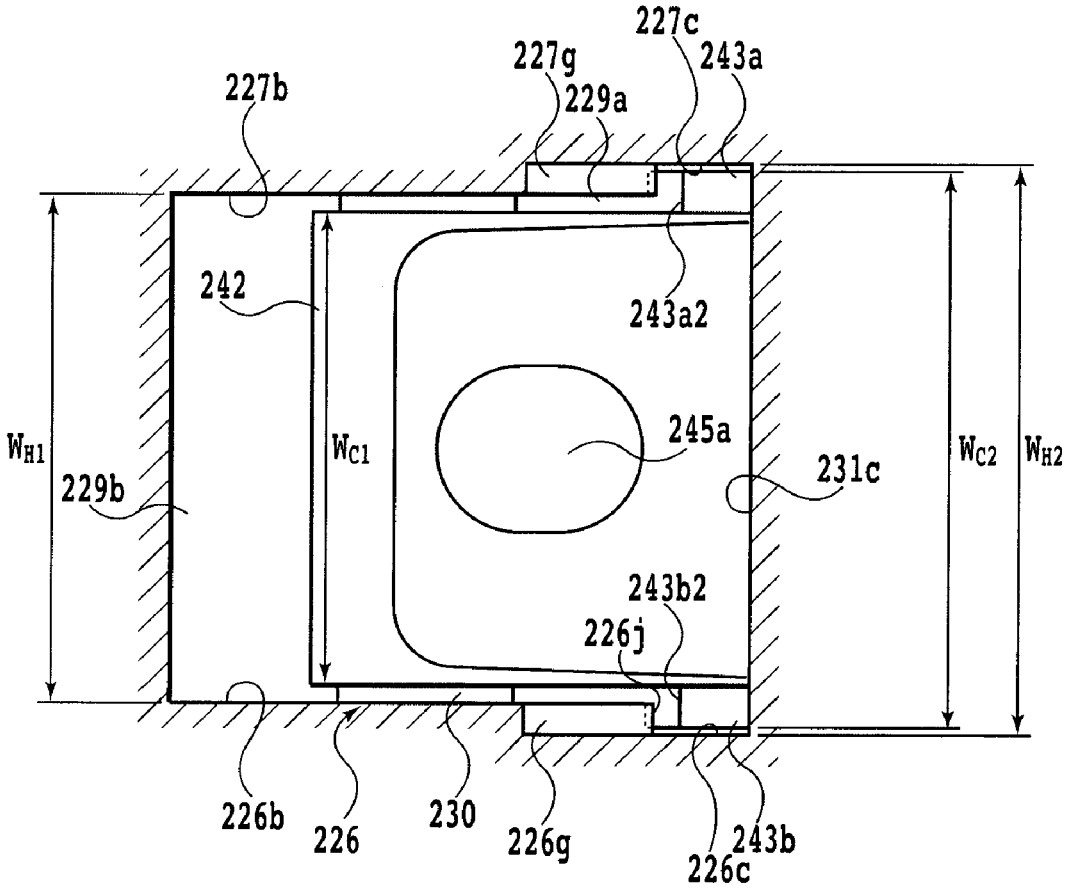
FIG. 10B is a partial bottom view showing the socket body of the IC socket, to which the contact shown in FIG. 10A is mounted, as viewed from under.
Figure 11:
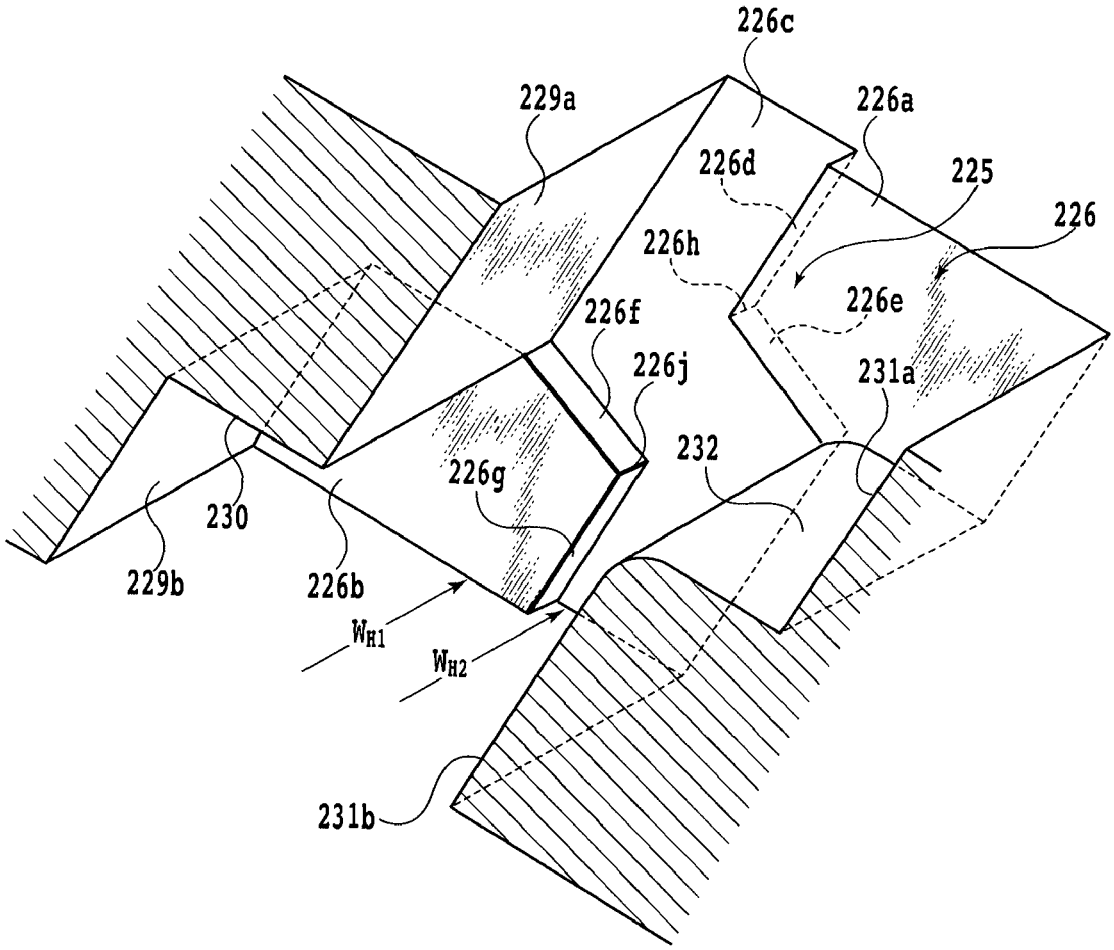
FIG. 11 is a partially cross sectional, perspective view showing a contact accommodating chamber of the socket body of the IC socket shown in FIG. 10A, in which the contact is not mounted.

The third embodiment of the invention will be described with reference to FIGS. 9 to 11. FIG. 9 is a perspective view showing a contact according to the third embodiment of the invention. FIG. 10A is a partially cross sectional view showing a state, in which the contact shown in FIG. 9 is mounted to a socket body of an IC socket and two contact objects are not mounted. FIG. 10B is a partial bottom view showing the socket body of the IC socket, to which the contact shown in FIG. 10A is mounted, as viewed from under. FIG. 11 is a partially cross sectional, perspective view showing a contact accommodating chamber of the socket body of the IC socket shown in FIG. 10A, in which the contact is not mounted.

Like in the first and second embodiments, a contact 240 in the embodiment is punched as an elongate band-shaped body having a predetermined shape from a conductive, metallic sheet and manufactured by bending the band-shaped body. Also, the contact 240 according to the embodiment is formed into a shape, which is contactable up and down with two contact objects as shown in FIG. 4, to be substantially Z-shaped as viewed laterally (in a direction indicated by an arrow B in FIG. 9). Further, the contact 240 according to the embodiment is structured to be point-symmetrical with respect to a center axis O-O of the contact 140 passing through a coupling portion 243.

The contact 240 according to the embodiment is fundamentally the same in structure as those of the first and second embodiments. In FIGS. 9 to 11, the same constituent parts as those in the first embodiment are denoted by reference numerals, which are obtained by simply adding 200 to the reference numerals in the latter, the constituent parts acting or functioning in the same manner as in the first embodiment. The contact 240 according to the embodiment and the contact 40 according to the first embodiment are different from each other in that the contact 240 according to the embodiment includes stop members 243*a*, 243*b* provided on both sides of the coupling portion 243. More specifically, the stop members 243*a*, 243*b* are formed to project outward from the both sides of the coupling portion 243 in a width direction (a vertical direction in FIG. 10B) along the center axis O-O of the contact 240. In addition, a difference also resides in that cut-out window portions 241*c*, 245*c*, 243*c*, respectively, are provided on first and second arm portions 241, 245, and the coupling portion 243 in the embodiment. However, the cut-out window portions 241*c*, 245*c*, 243*c* are provided in order to adjust the spring constant of the contact 240, which is elastically deformed as a Z-shaped spring.

Like the first embodiment, the contact 240 according to the embodiment includes the first arm portion 241 having a first contact portion 241*a* at a tip end thereof, a first arcuate projection 242, the flat, coupling portion 243, a second arcuate projection 244, and the second arm portion 245 having a second contact portion 245*a* at a tip end thereof. The first arm portion 241 and the coupling portion 243 are folded back with the first arcuate projection 242 therebetween, which is arcuate in cross section and has a radius R of curvature, whereby the portions are formed to assume a substantially V-shaped configuration. Further, the coupling portion 243 and the second arm portion 245 are folded back with the second arcuate projection 244 therebetween, which is arcuate in cross section and has a radius R of curvature, whereby the portions are formed to assume a substantially V-shaped configuration.

In the embodiment, as described above, a pair of the stop members 243*a*, 243*b* are formed to project outward from the both sides of the coupling portion 243 in the width direction along the center axis O-O of the contact 240. The pair of the stop members 243*a*, 243*b* in the embodiment are formed to be substantially rectangular-shaped in vertical section (section cut along a plane perpendicular to the center axis O-O) and comprise an upper corner portion 243*a*1 and a lower corner portion 243*a*2. The stop members 243*a*, 243*b* are not limited to the above in vertical sectional shape but may be oval, elliptical, or circular in shape. Also, as shown in FIG. 10A, rounded portions may be formed partially or wholly on the upper corner portions 243*a*1 of the stop members 243*a*, 243*b*.

As shown in FIG. 10B, $W_{C1}$ indicates a width of that portion of the coupling portion 243 of the contact 240, on which the stop members 243*a*, 243*b* are not formed, in the embodiment and $W_{C2}$ indicates a width of that portion, on which the stop members 243*a*, 243*b* are formed. Since the pair of the stop members 243*a*, 243*b* are formed to project from the both sides of the coupling portion 243 as described above, the width $W_{C2}$ of that portion, on which the stop members 243*a*, 243*b* are formed, is larger than the width $W_{C1}$. In addition, the width $W_{C1}$ is indicated as a width of the contact 240 and substantially the same as a width of the first and second arm portions 241, 245. Also, the width $W_{C1}$ may be the same as or different from a width of the contacts 40, 140 in the first and second embodiments.

Since the pair of the stop members 243*a*, 243*b* are formed on the contact 240 in the embodiment to project from the both sides of the coupling portion 243, a part of the structure of a contact accommodating chamber 225, in which the contact 240 is accommodated, is different from those in the first and second embodiments. Specifically, a difference also resides in the structures of side walls 226, 227 positioned up and down in FIG. 10B. The contact accommodating chamber 225 in the embodiment is shown in FIGS. 10A, 10B, and 11.

The contact accommodating chamber 225 in the embodiment extends through the socket body 20 and is defined by four side walls, and side walls opposed to each other on the left and right in FIG. 10A, out of the four side walls are the same as those in the first and second embodiments. That is, the side walls, respectively, opposed to each other on the left and right in FIG. 10A include first upper and lower inclined side walls 229*a*, 229*b*, a first horizontal step portion 230, second upper and lower inclined side walls 231*a*, 231*b*, and a second horizontal step portion 232.

The pair of side walls 226, 227 opposed to each other up and down in FIG. 10B, out of the four side walls are different in structure from those in the first and second embodiments. In the first and second embodiments, a pair of side walls corresponding to the pair of side walls 226, 227 include flat surfaces arranged in parallel to each other with a spacing, which is a little larger than a width of the contact 40 (or 140), therebetween. In the embodiment, however, stop member accommodating grooves (referred simply below to as "accommodating grooves") 226*c*, 227*c* are provided in pair on the opposed side walls 226, 227 in order to accommodate the pair of the stop members 243*a*, 243*b* of the contact 240.

Since the pair of side walls 226, 227 in the embodiment are the same in structure, one 226 of the side walls will be described in detail with reference to FIG. 11 and an explanation for the structure of the side wall 227 is omitted. In addition, the structure of the side wall 227 is understood by reading the explanation for the structure of the side wall 226 with the reference numeral 226 replaced by 227.

As shown in FIG. 11, formed on the side wall 226 is the accommodating groove 226*c* serving as an accommodating recess, in which the corresponding stop member 243*b* out of the pair of the stop members 243*a*, 243*b* of the contact 240 is accommodated.

The accommodating groove 226*c* in the embodiment is substantially S-shaped to extend from the bottom surface 22*a* of the recess 22 for IC package placement, of the socket body 20 to the bottom surface 23 of the socket body 20 to divide the side wall 226 into upper and lower sections to extend through the socket body 20. Specifically, a groove is formed to extend from the bottom surface 22*a* of the recess 22 for IC package placement to the first horizontal step portion 230 along the first upper inclined side wall 229*a*, which defines the contact accommodating chamber 225. Likewise, a groove is formed to extend from the bottom surface 23 of the socket body 20 to the second horizontal step portion 232 along the second lower inclined side wall 231*b*. Two grooves formed on a side of the bottom surface 22*a* of the recess 22 for IC package placement and on a side of the bottom surface 23 of the socket body 20 are connected to each other by a groove, which is formed perpendicularly to the first upper inclined side wall 229*a* and the second lower inclined side wall 231*b*, which are parallel to each other, whereby the accommodating groove 226*c* is formed.

An upper side wall 226*a* and a lower side wall 226*b*, which are segmented up and down, of the side wall 226 are disposed in the same plane. Also, a first step portion 226*d* in parallel to the first upper inclined side wall 229*a* and a second step portion 226*e* perpendicular to the second lower inclined side wall 231*b* are formed between the accommodating groove 226*c* and the upper side wall 226*a*. Likewise, a fourth step portion 226*g* in parallel to the second lower inclined side wall 231*b* and a third step portion 226*f* perpendicular to the first upper inclined side wall 229*a* are formed between the accommodating groove 226*c* and the lower side wall 226*b*. Accordingly, the first step portion 226*d* and the fourth step portion 226*g*, and the second step portion 226*e* and the third step portion 226*f*, respectively, are parallel to each other. In addition, the reference numeral 226*h* denotes a first ridgeline, on which the first step portion 226*d* and the second step portion 226*e* intersect each other, and 226*j* denotes a second ridgeline, on which the third step portion 226*f* and the fourth step portion 226*g* intersect each other.

FIG. 10A shows a state, in which the contact 240 is mounted stably in the contact accommodating chamber 225.

In this state, Y denotes a direction, in which the second arcuate projection 244 moves horizontally on the second horizontal step portion 232 when an intense force X is exerted on the first contact portion 241*a* of the contact 240 from above. In the embodiment, a distance L between a lower corner portion 243*b*2 and an extension of the fourth step portion 226*g* is set to meet L>0. Similarly, a distance L between a upper corner portion 243*b*1 and an extension of the first step portion 226*d* is set to meet L>0.

Also, $W_{H1}$ indicates a distance between the lower side walls 226*b* and 227*b* (or the upper side walls), which are formed in pair on the pair of side walls 226, 227 of the contact accommodating chamber 225. Further, $W_{H2}$ indicates a distance between the pair of the accommodating grooves 226*c* and 227*c*. At this time, a width of the contact 240 and a distance between the pair of side walls 226, 227 of the contact accommodating chamber 225 are set to meet $W_{H2}>W_{C2}>W_{H1}>W_{C1}$.

By setting the contact 240 and the contact accommodating chamber 225 in this manner, the second arcuate projection 244 moves horizontally in a left direction as shown in FIG. 10A when an intense, downward force X is exerted only on the first contact portion 241*a*. As the second arcuate projection 244 moves, the pair of the stop members 243*a*, 243*b* of the contact 240 move in the left direction. The pair of the stop members is positioned on the pair of the step portions 226*f*, 227*f* since the distance L between the lower corner portion 243*b*2 and the extension of the fourth step portion 226*g* is set to meet L>0. Accordingly, the pair of the stop members 243*a*, 243*b* of the contact 240 abuts against the pair of the step portions 226*f*, 227*f* even when an intense, downward force X is exerted on the first contact portion 241*a*. Thereby, the contact 240 in the embodiment does not come off the contact accommodating chamber 225 even when it comes off the horizontal step portion 232 and slides down a little. Likewise, the contact 240 does not spring upward from the contact accommodating chamber 225 even when an intense, upward force is exerted on the second contact portion 245*a*.

The contact 240 according to the embodiment and the IC socket provided with the contact accommodating chamber 225, which accommodates the same, further produce the function and effect as described above in addition to the function and effect, which are produced by the contact according to the first embodiment and the IC socket making use of the same.

In addition, when the contact 240 is to be taken out of the contact accommodating chamber 225, a force is exerted in a direction indicated by an arrow Z as shown in FIG. 10A. Thereby, the pair of the stop members 243*a*, 243*b* of the contact 240 are moved rightwardly of the pair of the second ridgelines 226*j*, 227*j* to be positioned in the accommodating grooves 226*c*, 227*c* along the second lower inclined side wall 231*b*. That is, a distance L<0 is met. Subsequently, by pulling the contact 240 downward, the contact 240 can be taken out of the contact accommodating chamber 225. Also, a reverse operation is performed whereby the contact 240 can be mounted in the contact accommodating chamber 225. In addition, in order to have the contact 240 easily taken out of the contact accommodating chamber 225 or easily mounted in the contact accommodating chamber 225, a vertical notch 231*c* may be provided on the second lower inclined side wall 231*b* as shown in FIG. 10A.

Fourth Embodiment

Figure 12:
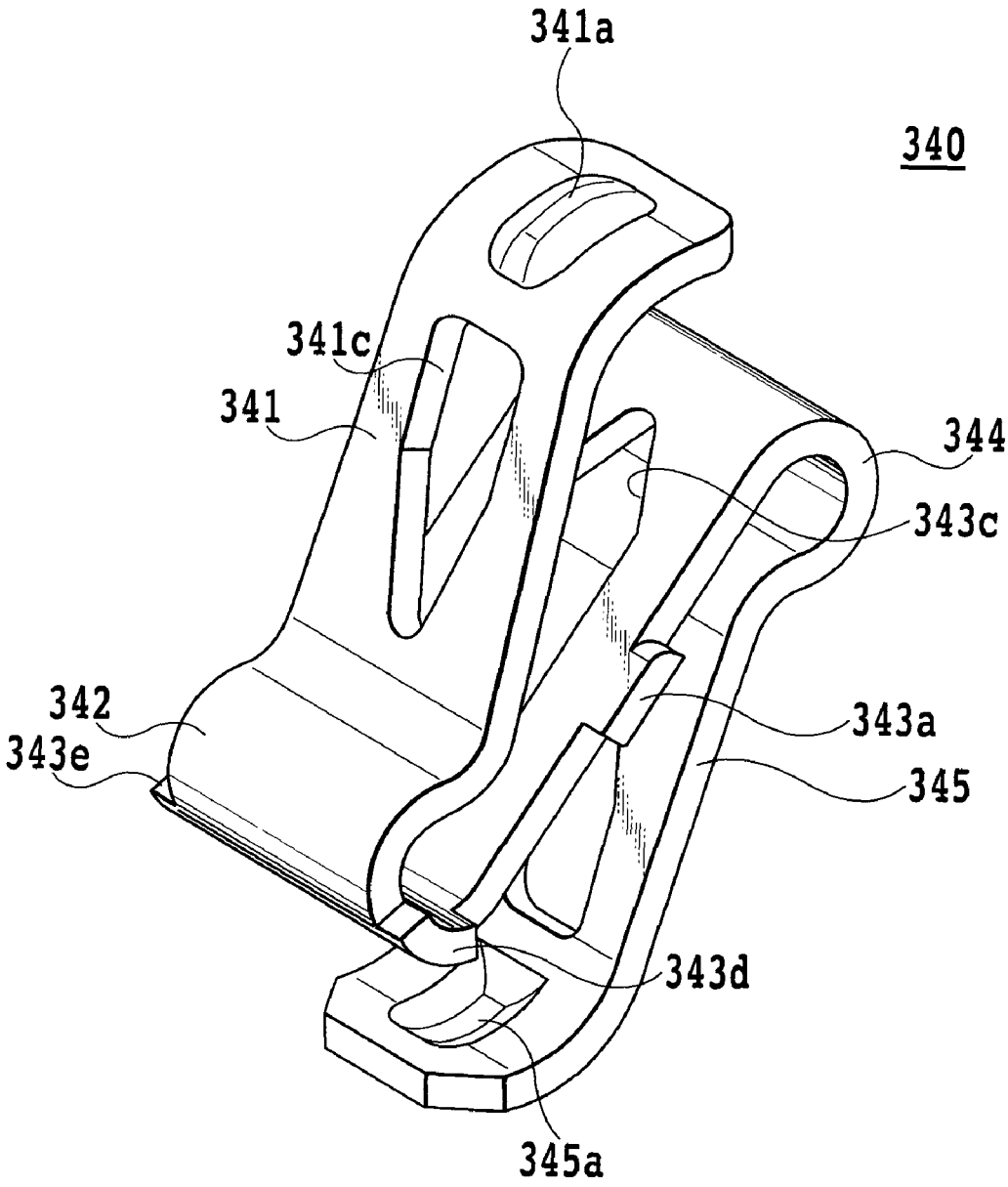
FIG. 12 is a perspective view showing a contact according to a fourth embodiment of the invention.
Figure 13A:
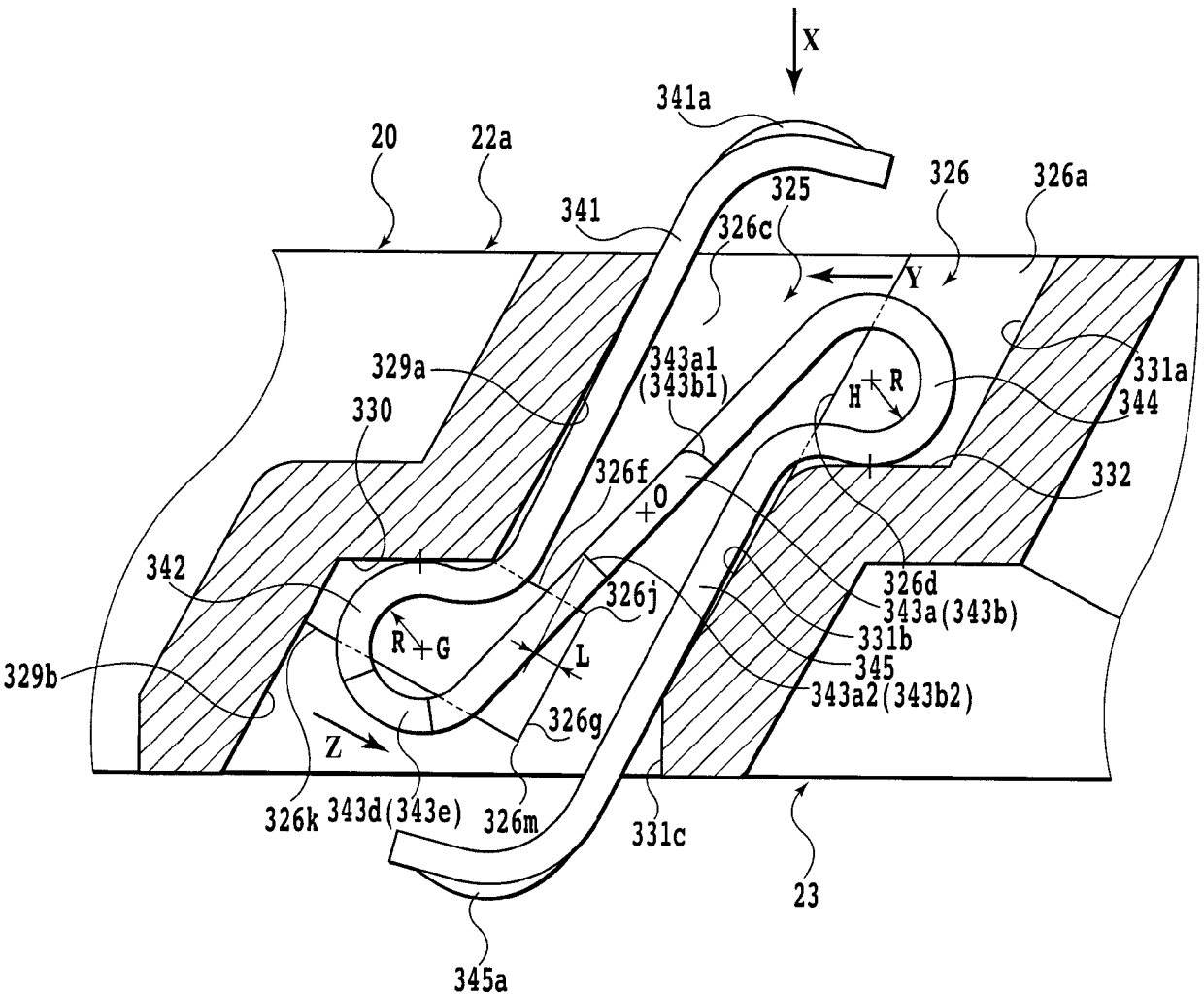
FIG. 13A is a partially cross sectional view showing a state, in which the contact shown in FIG. 12 is mounted to a socket body of an IC socket and two contact objects are not mounted.
Figure 13B:
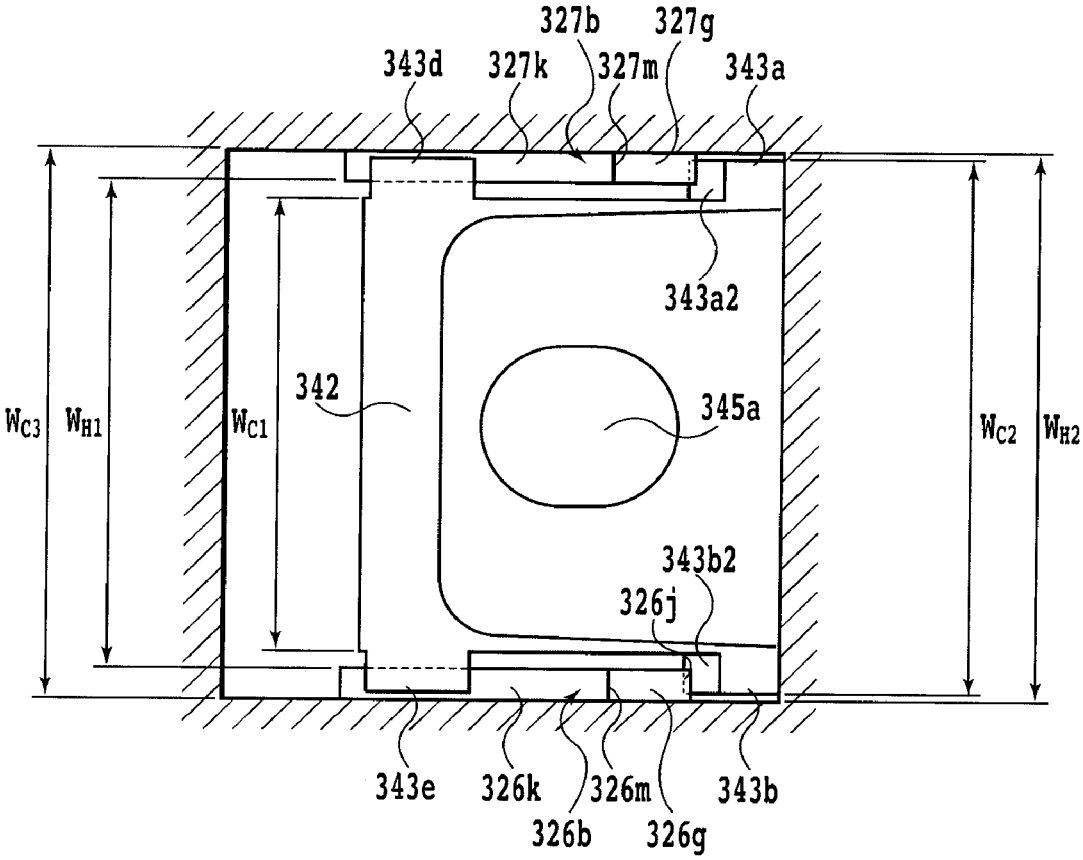
FIG. 13B is a partial bottom view showing the socket body of the IC socket, to which the contact shown in FIG. 13A is mounted, as viewed from under.
Figure 14:
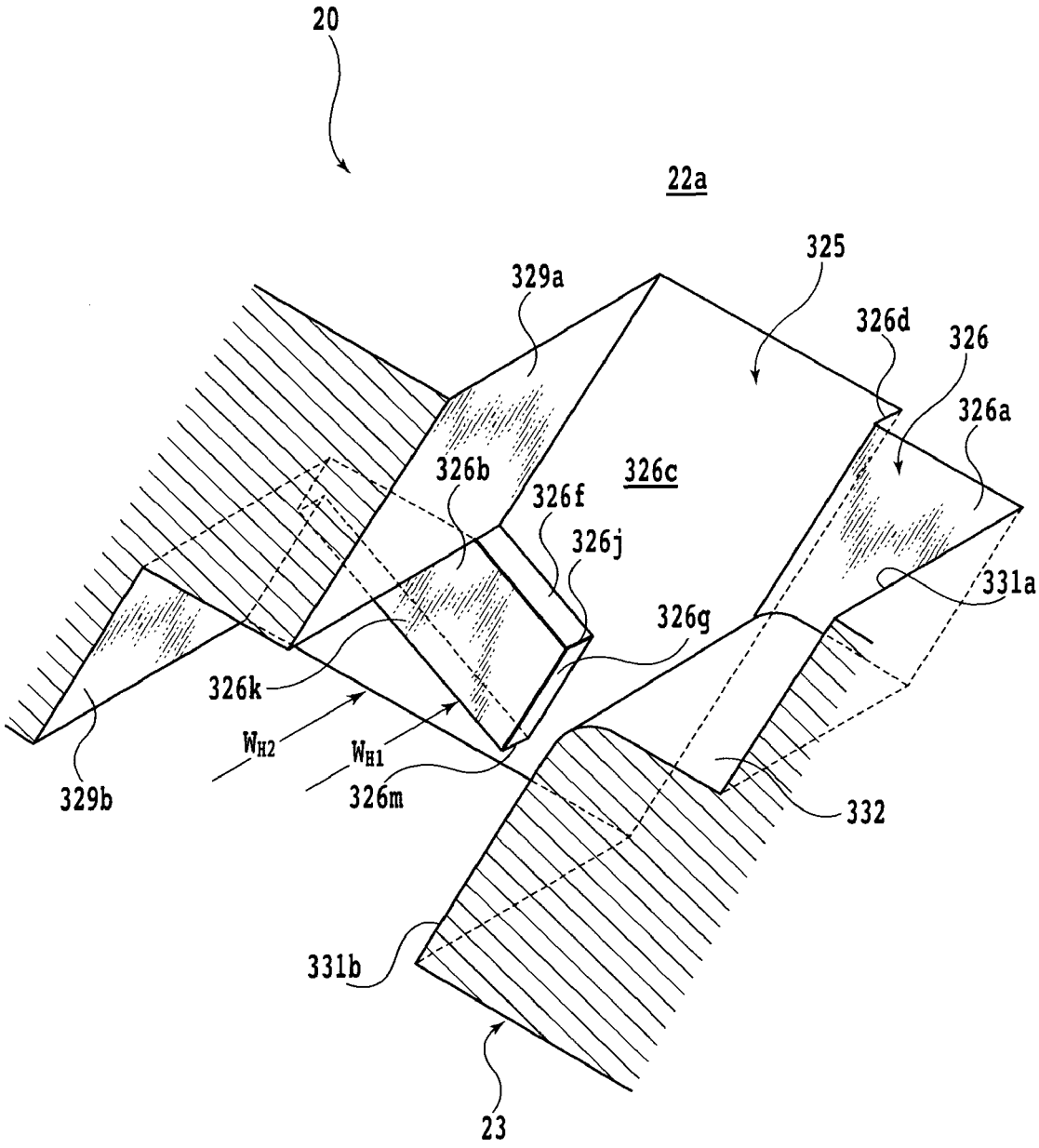
FIG. 14 is a partially cross sectional, perspective view showing a contact accommodating chamber of the socket body of the IC socket shown in FIG. 13A, in which the contact is not mounted.

Subsequently, a fourth embodiment will be described with reference to FIGS. 12 to 14. FIG. 12 is a perspective view showing a contact according to a fourth embodiment. FIG. 13A is a partially cross sectional view showing a state, in which the contact shown in FIG. 12 is mounted to a socket body of an IC socket and two contact objects are not mounted. FIG. 13B is a partial bottom view showing the socket body of the IC socket, to which the contact shown in FIG. 13A is mounted, as viewed from under. FIG. 14 is a partially cross sectional, perspective view showing a contact accommodating chamber of the socket body of the IC socket shown in FIG. 13A, in which the contact is not mounted.

In the embodiment, stop members of a contact 340 and a contact accommodating chamber 325 corresponding thereto are a little different in structure from those in the third embodiment but the remaining structure is quite the same as the latter. Accordingly, parts or members, reference numerals of which are the same, or reference numerals of which are indicated with 200 simply replaced by 300 and with the last two figures and characters being the same, correspond to the same parts or members, and an explanation therefor is omitted.

The contact 340 according to the embodiment is different from that of the third embodiment only in that two pairs of stop members are provided. Specifically, a pair of first stop members 343*a*, 343*b* is formed to project outward from both sides of a coupling portion 343 in a width direction along a center axis O-O of the contact 340. This construction is the same as that of the third embodiment, $W_{C1}$ indicates a width of that portion of the coupling portion 343 of the contact 340, on which the stop members 343*a*, 343*b* are not formed, in the embodiment and $W_{C2}$ indicates a width of that portions, on which the stop members 343*a*, 343*b* are formed.

In the embodiment, as shown in FIGS. 12 and 13B, further, a pair of second stop members 343*d*, 343*e* is formed to project outward from both sides of a first arcuate projection 342 and in parallel to the first stop members. Assuming that $W_{C3}$ indicates a width of that portion of the first arcuate projection 342, on which the pair of second stop members 343*d*, 343*e* are formed, $W_{C3}=W_{C2}>W_{C1}$ is preferable but this is not limitative.

In the embodiment, as accommodating recesses, which accommodate two pair of stop members, a pair of accommodating grooves 326*c*, 327*c* are formed on a pair of side walls 326, 327 of the contact accommodating chamber 325, which are opposed to each other up and down in FIG. 13B.

Since the pair of side walls 326, 327 in the embodiment are the same in structure, one 326 of the side walls will be described in detail with reference to FIG. 14 and an explanation for the structure of the side wall 327 is omitted. As shown in FIG. 14, formed on the side wall 326 is the accommodating groove 326*c*, in which the corresponding stop members 343*b*, 343*e* out of the pair of the first and second stop members 343*a*, 343*b* and 343*d*, 343*e* of the contact 340 are accommodated.

The accommodating groove 326*c* in the embodiment is formed to extend from the bottom surface 22*a* of the recess 22 for IC package placement, of the socket body 20 to the bottom surface 23 of the socket body 20 to divide the side wall 326 into upper and lower sections to extend through the socket body 20. Specifically, a first groove is formed to extend from the bottom surface 22*a* of the recess 22 for IC package placement to a first horizontal step portion 330 along a first upper inclined side wall 329*a* and a second lower inclined side wall 331*b*, which define the contact accommodating chamber 325. A groove is formed to extend from the bottom surface 23 of the socket body 20 to a predetermined position along the first upper inclined side wall 329*a* and the second lower inclined side wall 331*b*. Two grooves formed on a side of the bottom surface 22*a* of the recess 22 for IC package placement and on a side of the bottom surface 23 of the socket body 20 are connected to each other by a groove, which is formed along the second lower inclined side wall 331*b*, whereby the accommodating groove 326*c* is formed.

An upper side wall 326*a* and a lower side wall 326*b*, which are segmented up and down by the accommodating groove 326*c* of the side wall 226, are disposed on the same plane. Also, a first step portion 326*d* in parallel to the first upper inclined side wall 329*a* to extend from the second lower inclined side wall 331*b* are formed between the accommodating groove 326*c* and the upper side wall 326*a*. Also, a third step portion 326*f* perpendicular to the first upper inclined side wall 329*a*, a fourth step portion 326*g* in parallel to the second lower inclined side wall 331*b*, and a fifth step portion 326*k* in parallel to the third step portion 326*f* are formed between the accommodating groove 326*c* and the lower side wall 326*b*. Further, the third and fifth step portions 326*f*, 326*k* are formed to be arranged between the first and second stop members 343*b*, 343*e* of the contact 340 as shown in FIG. 13A when the contact 340 is mounted in the contact accommodating chamber 325. In other words, when the contact 340 is mounted in the contact accommodating chamber 325, the lower side wall 326*b* is present between the first and second stop members 343*b*, 343*e* in a manner to cross the first arcuate projection 342 and the coupling portion 343 of the contact 340. In addition, the reference numeral 326*j* denotes a second ridgeline, on which the third step portion 326*f* and the fourth step portion 326*g* intersect each other and 326*m* denotes a third ridgeline, on which the fourth step portion 326*g* and the fifth step portion 326*k* intersect each other.

FIG. 13A shows a state, in which the contact 340 is mounted stably in the contact accommodating chamber 325. In this state, Y denotes a direction, in which the second arcuate projection 344 moves horizontally on the second horizontal step portion 332 when an intense force X is exerted on a first contact portion 341*a* of the contact 340 from above.

$W_{H1}$ indicates a distance between the lower side walls 326*b* and 327*b* (or the upper side walls), which are formed in pair on the pair of side walls 326, 327 of the contact accommodating chamber 325. Further, $W_{H2}$ indicates a distance between the pair of the accommodating grooves 326*c* and 327*c*. At this time, a width of the contact 340 and a distance between the pair of side walls 326, 327 of the contact accommodating chamber 325 are set to meet $W_{H2}>W_{C3}=W_{C2}>W_{H1}>W_{C1}$.

By setting the contact 340 and the contact accommodating chamber 325 in this manner, the contact 340 does not come off the contact accommodating chamber 325 in the same manner as in the third embodiment even when an intense, downward force X is exerted only on the first contact portion 341*a*. Also, when an intense, upward force is exerted only on a second contact portion 345*a*, the first arcuate projection 342 moves horizontally in a right direction as shown in FIG. 13A. In the embodiment, however, the pair of second stop members 343*d*, 343*e* is provided on the first arcuate projection 342. The pair of second stop members 343*d*, 343*e* abut against the pair of the fifth step portions 326*k*, 327*k* formed on the pair of side walls 326, 327, which define the contact accommodating chamber 325, to inhibit the first arcuate projection 342 from moving in the right direction. Thereby, the first arcuate projection 342 is also inhibited from moving upward, so that the contact 340 does not spring upward from the contact accommodating chamber 325. That is, in the embodiment, the contact 340 is inhibited from springing from the contact accommodating chamber in the same manner as in the third embodiment. Accordingly, the contact 340 according to the embodiment and the IC socket provided with the contact accommodating chamber 325, which accommodates the same, further produce the function and effect as described above in addition to the function and effect, which are produced by the contact according to the first embodiment and the IC socket making use of the same.

In addition, in the embodiment, the pair of second stop members 343*d*, 343*e* are provided on the first arcuate projection 342 of the contact 340 but a pair of second stop members may be provided on the second arcuate projection 344. In this case, upper side walls 326*a* (the corresponding upper side wall on a side of the side wall 327 is not shown) are formed in pair on the pair of side walls 326, 327, which define the contact accommodating chamber 325, in a manner to cross the second arcuate projection 344 and the coupling portion 343 of the contact 340.

Fifth Embodiment

In the first embodiment, the first and second contact portions 41*a*, 45*a* are deformed substantially independently of two upper and lower contact objects, with which the contact 40 contacts. Accordingly, in the case where respective external contacts of the contact objects as mounted up and down differ from each other in position, the first and second contact portions 41*a*, 45*a* differ from each other in magnitude of deformation. Accordingly, contact pressures, with which the contact portions of the contact and external contacts of the objects contact with each other, are different between up and down to cause a fear that an electrically unstable state is generated. In the fifth embodiment, an improvement is achieved in arrangement of the contact of the first embodiment in the contact accommodating chamber so as to enable preventing generation of an unstable state, in which contact pressures on two contact objects are different from each other.

Figure 15:
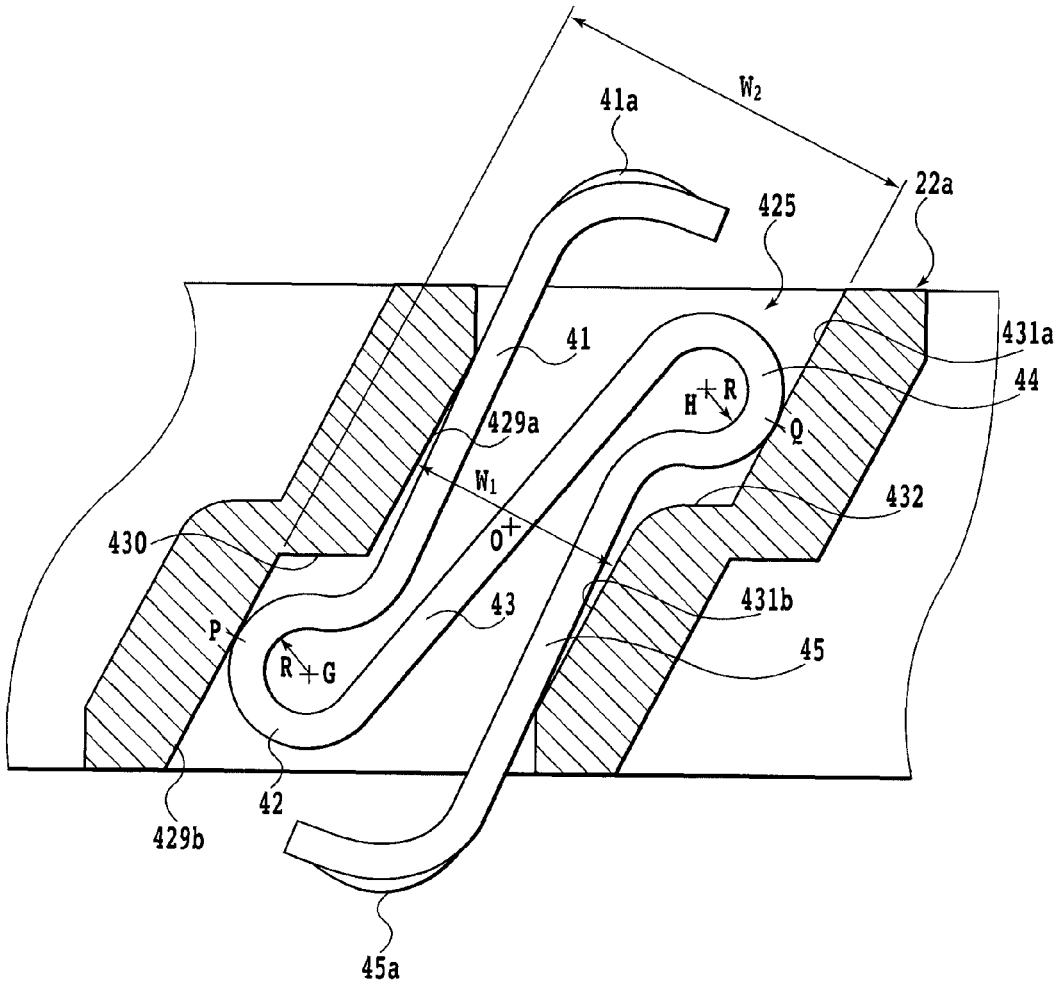
FIG. 15 is a partially cross sectional view showing a state, in which the contact according to the first embodiment is mounted to a socket body of an IC socket according to a fifth embodiment of the invention and two contact objects are not mounted.

Subsequently, a fifth embodiment of the invention will be described with reference to FIG. 15. FIG. 15 is a partially cross sectional view showing a state, in which the contact according to the first embodiment is mounted to a socket body of an IC socket according to the fifth embodiment of the invention and two contact objects are not mounted.

As shown in FIG. 15, a contact according to the embodiment is the same as the contact 40 according to the first embodiment. Accordingly, an explanation for the contact 40 is omitted. In the embodiment, a contact accommodating chamber 425, in which the contact 40 is accommodated, is different from that of the first embodiment. That is, in the embodiment, heights of a first horizontal step portion 430 and a second horizontal step portion 432, which define the contact accommodating chamber 425, and a spacing (vertical distance) W2 between a first lower inclined side wall 429*b* and a second upper inclined side wall 431*a* are different in magnitude from those of the first embodiment. The remaining structure of the contact accommodating chamber 425 is the same as that of the first embodiment.

Specifically, in the embodiment, the first horizontal step portion 430 is formed in a position being higher in a height from the bottom surface 23 of the socket body 20 than that of the first embodiment. Also, the second horizontal step portion 432 is formed so that its height from the bottom surface 23 of the socket body 20 is lower than that of the first embodiment. Like the first embodiment, however, the relationship, in which the first horizontal step portion 430 is formed below the second horizontal step portion 432, is maintained. Further, in the embodiment, the height of the second horizontal step portion 432 and the spacing W2 between the first lower inclined side wall 429*b* and the second upper inclined side wall 431*a* are set to be smaller than the depth T2 of the contact 40, so that the contact accommodating chamber 425 is formed to be smaller than that of the first embodiment in the spacing W2.

By structuring the contact accommodating chamber 425 in this manner, the contact 40 is supported on the first lower inclined side wall 429*b* and the second upper inclined side wall 431*a* of the contact accommodating chamber 425 when the contact 40 is mounted in a contact accommodating space as shown in FIG. 15. That is, unlike the first embodiment, the first arcuate projection 42 in the embodiment contacts with the first lower inclined side wall 429*b* of the contact accommodating chamber 425 at a contact point P disposed on a circle of curvature, which circumscribes the first arcuate projection. Also, the second arcuate projection 44 contacts with the second upper inclined side wall 431*a* of the contact accommodating chamber 425 at a contact point Q disposed on a circle of curvature, which circumscribes the second arcuate projection. That is, in the embodiment, when the contact 40 is mounted in the contact accommodating chamber 425 as shown in FIG. 15, both the first and second arcuate projections 42, 44 are arranged away from the first horizontal step portion 430 and the second horizontal step portion 432, respectively.

It is to be understood that when mounted in the contact accommodating chamber 425, the contact 40 is supported in four locations, that is, the first upper inclined side wall 429*a*, the first lower inclined side wall 429*b*, the second upper inclined side wall 431*a*, and the second lower inclined side wall 431*b* as shown in FIG. 15. Specifically, the first arm portion 41 of the contact 40 is supported on the first upper inclined side wall 429*a*, the first arcuate projection 42 is supported on the first lower inclined side wall 429*b*, the second arcuate projection 44 is supported on the second upper inclined side wall 431*a*, and the second arm portion 45 is supported on the second lower inclined side wall 431*b*. Accordingly, in the embodiment, the contact 40 is also self-held in the contact accommodating chamber 425 by its own spring restoring force.

In the embodiment, the first and second arcuate projections 42, 44 are arranged away from the first horizontal step portion 430 and the second horizontal step portion 432, respectively, whereby the contact 40 can be moved up and down in the contact accommodating chamber 425. Thereby, when external contacts of two contact objects, with which the first and second contact portions 41*a*, 45*a* of the contact 40 contact, differ from each other in position, the first and second contact portions 41*a*, 45*a* can be made the same in magnitude of deformation from each other by beforehand moving the contact 40 up and down.

Sixth Embodiment

Figure 16:
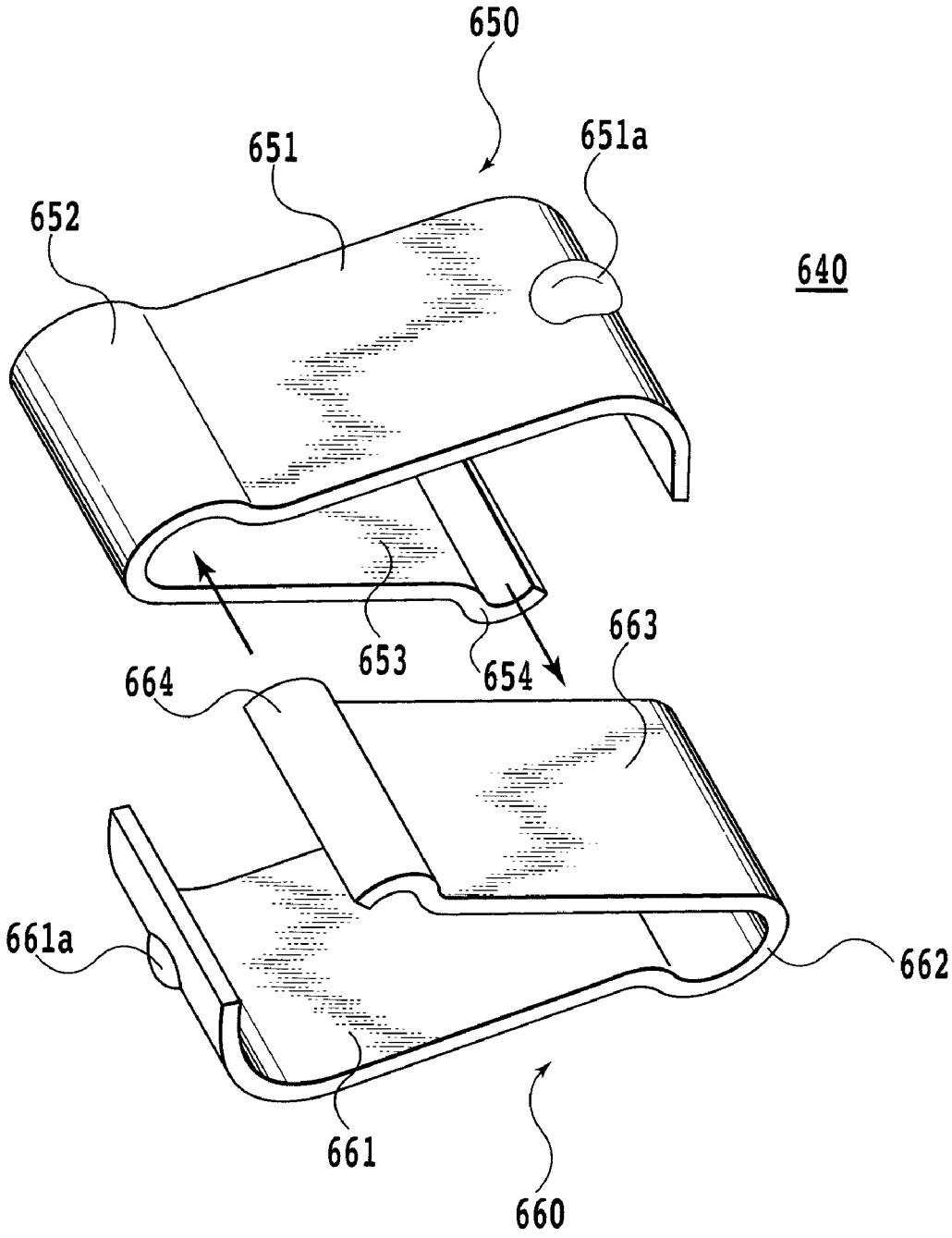
FIG. 16 is an exploded, perspective view showing a contact according to a sixth embodiment of the invention.
Figure 17:
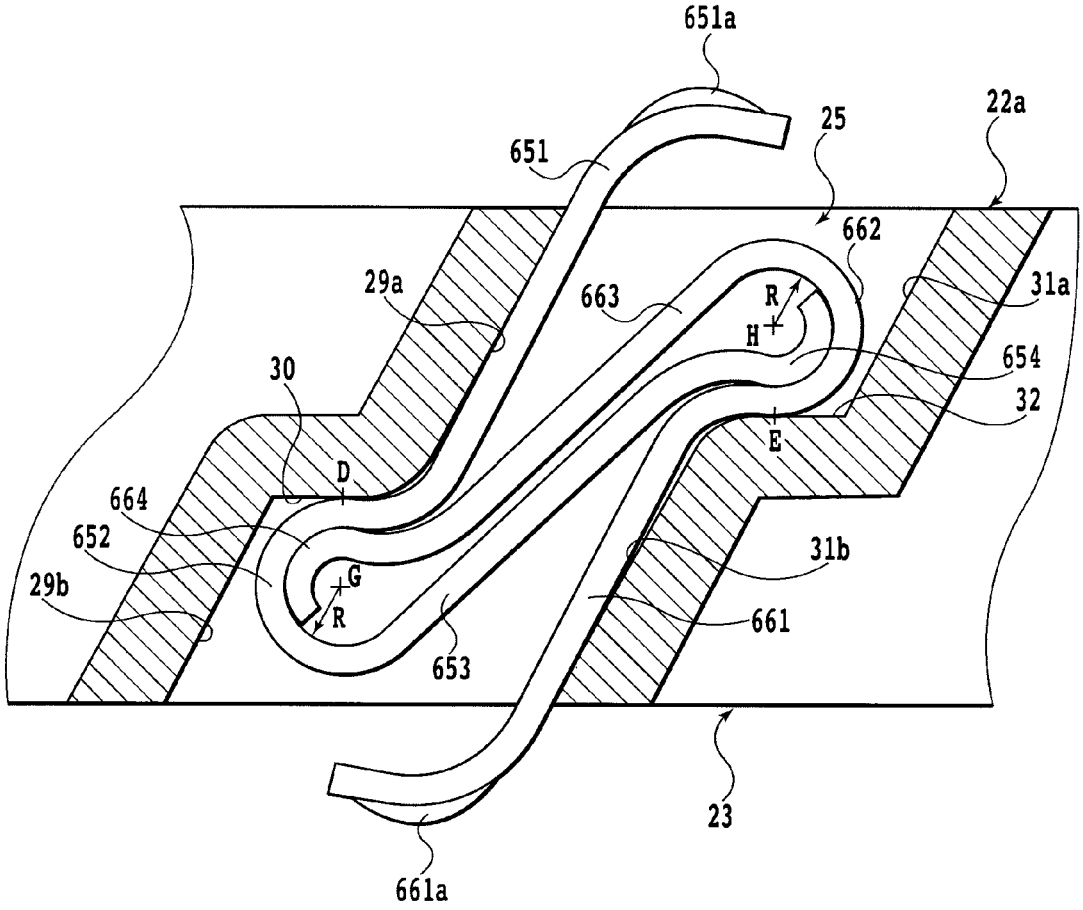
FIG. 17 is a partially cross sectional view showing a state, in which the contact shown in FIG. 16 is mounted to a socket body of an IC socket and two contact objects are not mounted.
Figure 18:
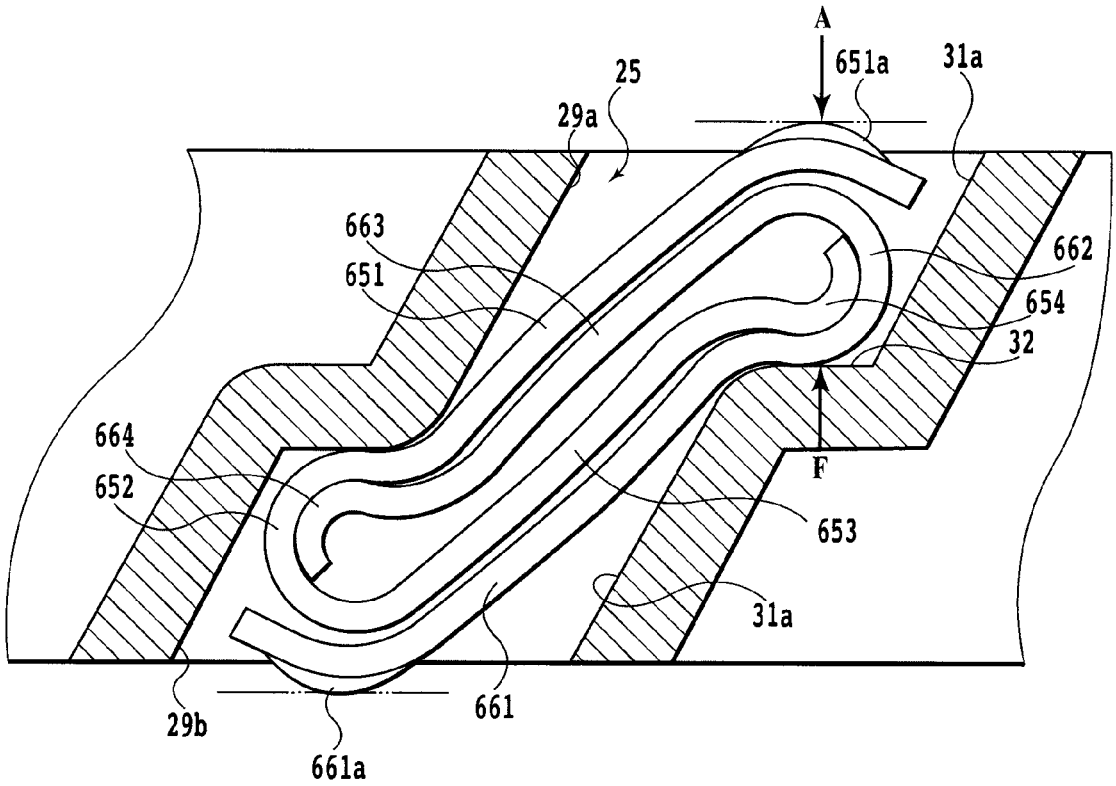
FIG. 18 is a partially cross sectional view being similar to FIG. 17 and showing a state, in which two contact objects are mounted to an IC socket and the contact shown in FIG. 16 contacts electrically with the two contact objects.

Sixth and seventh embodiments according to the invention constitute modifications of the contact according to the first embodiment. First, the sixth embodiment will be described with reference to FIGS. 16 to 18. FIG. 16 is an exploded, perspective view showing a contact according to the sixth embodiment of the invention and FIG. 17 is a partially cross sectional view showing a state, in which the contact shown in FIG. 16 is mounted to a socket body of an IC socket and two contact objects are not mounted. FIG. 18 is a partially cross sectional view being similar to FIG. 17 and showing a state, in which two contact objects are mounted to the IC socket and the contact shown in FIG. 16 contacts electrically with the two contact objects.

Since a contact accommodating chamber in the embodiment is quite the same in structure as the contact accommodating chamber 25 of the first embodiment, an explanation therefor is omitted.

In the embodiment, a contact 640 is different in structure from that of the first embodiment. That is, in the embodiment, the contact 640 includes two contact members, that is, a first contact member 650 and a second contact member 660. The two contact members 650, 660 are not limitative but are preferably quite the same in structure.

The two contact members 650, 660, which constitute the contact 640, are punched as elongate band-shaped bodies having a predetermined shape from a conductive, metallic sheet such as beryllium copper (BeCu) and formed by bending the band-shaped bodies. The first and second contact members 650, 660 are combined together as shown in FIG. 16 and formed into a shape, which is contactable up and down with two contact objects, in the same manner as the contact 40 in the first embodiment. The contact 640 according to the embodiment is substantially Z-shaped as viewed laterally. The contact 640 formed by combining the two contact members 650, 660 together is formed to be the same in height, width and depth as the contact 40 in the first embodiment.

In the embodiment, since the two contact members 650, 660 are quite the same in structure, the first contact member 650 will be described herein and an explanation for the second contact member 660 is omitted. In addition, the second contact member 660 is understood by reading the explanation for the first contact member 650 with the reference numeral 650 replaced by 660.

The first contact member 650 includes a first flat arm portion 651 having a first contact portion 651*a* at a tip end thereof being a free end, an arcuate projection 652, and a second flat arm portion 653 having an engagement portion 654 at a tip end thereof being a free end. The first arm portion 651 and the second arm portion 653 are folded back with an arcuate projection 652 therebetween, which is arcuate in cross section and has a circle of curvature, of which an inscribing circle inscribing the arc has a radius R of curvature, whereby the portions are connected to each other to assume a substantially V-shaped configuration.

Here, a connected structure of the first arm portion 651 and the second arm portion 653 with the arcuate projection 652 therebetween is the same as a connected structure of the first arm portion 41 and the coupling portion 43 with the first arcuate projection 42 therebetween in the first embodiment. Also, formed at the tip end (or a free end) of the second arm portion 653 is the engagement portion 654 as a contact portion in contact with an inner peripheral surface of an arcuate projection 662 of the second contact member 660. The engagement portion 654 provided at the tip end of the second arm portion 653 is semi-circular in cross section and formed so that a circumscribing circle thereof has a radius, which is substantially the same as or a little smaller than a radius R of curvature of a circle of curvature inscribed in the arcuate projection 652. The semi-circular engagement portion 654 is formed at the tip end of the second arm portion 653 in a manner to project in a direction away from the opposed contact portion 651*a*.

As shown in FIG. 17, the arcuate projection 652 of the first contact member 650 is formed so as to have a circle of curvature thereof contacting with the horizontal step portion 30 at a contact point D disposed on the circle when the contact 640 is mounted in the contact accommodating chamber 25. That is, the arcuate projection 652 of the first contact member 650 is formed in a manner to project outward from the first arm portion 651.

The first arm portion 651 and the second arm portion 653 are formed connectedly with the arcuate projection 652 therebetween whereby the first arm portion 651 and the second arm portion 653 can be elastically deformed about a center G of curvature of the arcuate projection 652. When the contact 640 is mounted in the contact accommodating chamber 25 as shown in FIG. 18, a reaction force F is applied to the engagement portion 654 of the second arm portion 653 from the second contact member 660 when a downwardly directed contact force A is exerted on the contact portion 651*a* of the first arm portion 651. Accordingly, the first and second arm portions 651, 653 are elastically deformed whereby the first contact member 650 is improved in spring characteristic as compared with that of the first embodiment. This can also be said with respect to the second contact member 660.

As described above, the contact 640 according to the embodiment is formed by combining the first and second contact members 650, 660 together as shown in FIG. 17. Specifically, as shown in FIG. 16, the second arm portion 653 of the first contact member 650 and a second arm portion 663 of the second contact member 660 are arranged in a manner to face each other and to be made parallel to each other. Subsequently, a fitting portion 664 of the second arm portion 663 of the second contact member 660 is fitted into the arcuate projection 652 of the first contact member 650. At the same time, a fitting portion 654 of the second arm portion 653 of the first contact member 650 is fitted into the arcuate projection 662 of the second contact member 660. Thereby, the contact 640 being the same in height, width and depth as the contact 40 in the first embodiment is formed.

When the contact 640 according to the embodiment is mounted in the contact accommodating chamber 25 as shown in FIG. 17, the first arm portion 651 of the first contact member 650 is supported on the first upper inclined side wall 29*a*, which defines the contact accommodating chamber 25. Also, the arcuate projection 652 of the first contact member 650 is supported on the first horizontal step portion 30, which defines the contact accommodating chamber 25. Likewise, the arcuate projection 662 of the second contact member 660 is supported on the second horizontal step portion 32 and a first arm portion 661 of the second contact member 660 is supported on the second lower inclined side wall 31*b*.

The contact 640 according to the embodiment is structured as described above to produce the same function and effect as those in the first embodiment, the contact 640 being simple in structure to be readily manufactured and excellent in spring characteristic.

Seventh Embodiment

Figure 19:
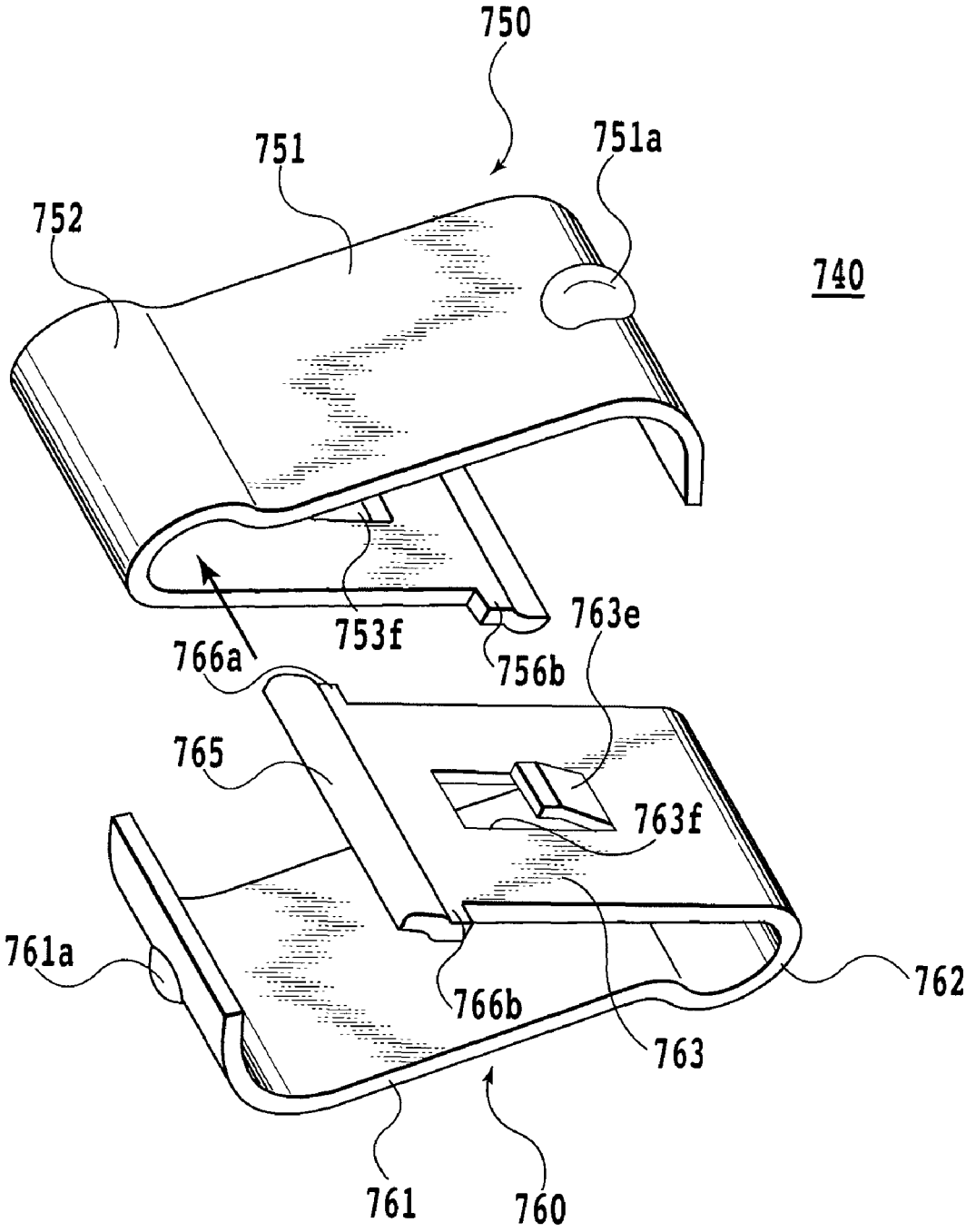
FIG. 19 is an exploded, perspective view showing a contact according to a seventh embodiment of the invention.
Figure 20:
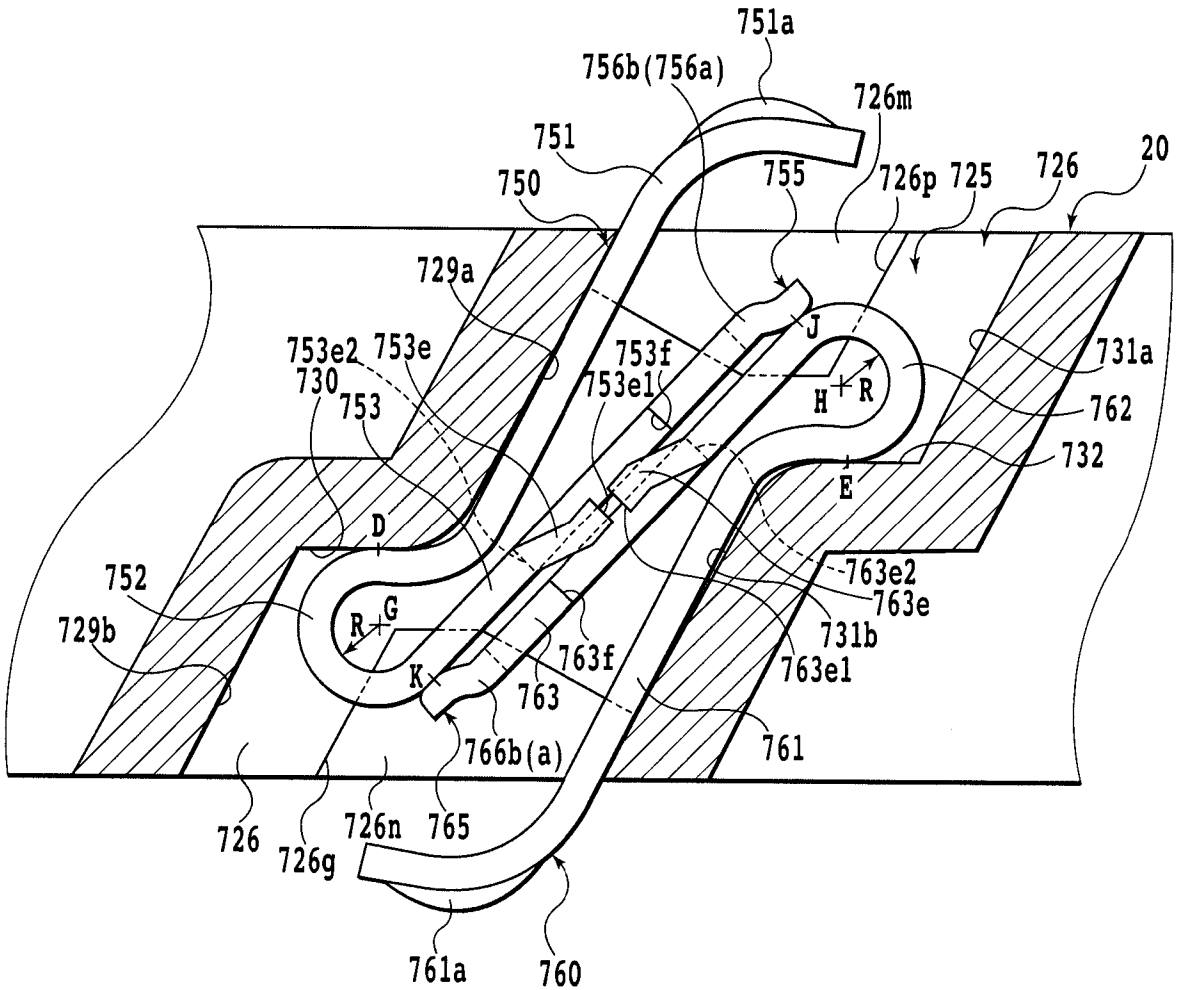
FIG. 20 is a partially cross sectional view showing a state, in which the contact shown in FIG. 19 is mounted to a socket body of an IC socket and two contact objects are not mounted.
Figure 21:
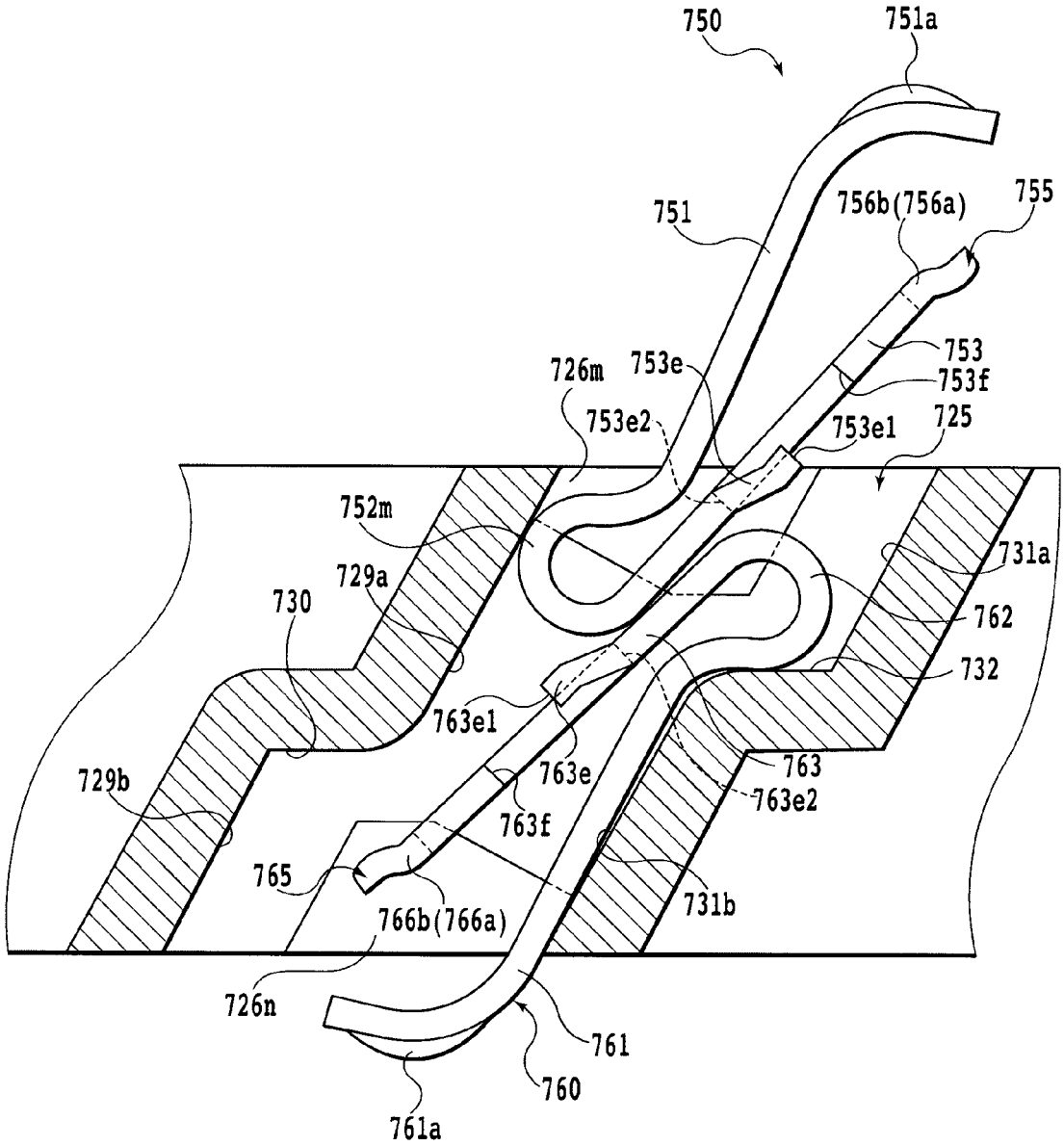
FIG. 21 is a partially cross sectional view being similar to FIG. 20 and illustrating an operation, in which a contact is mounted in a contact accommodating chamber of an IC socket.
Figure 22:
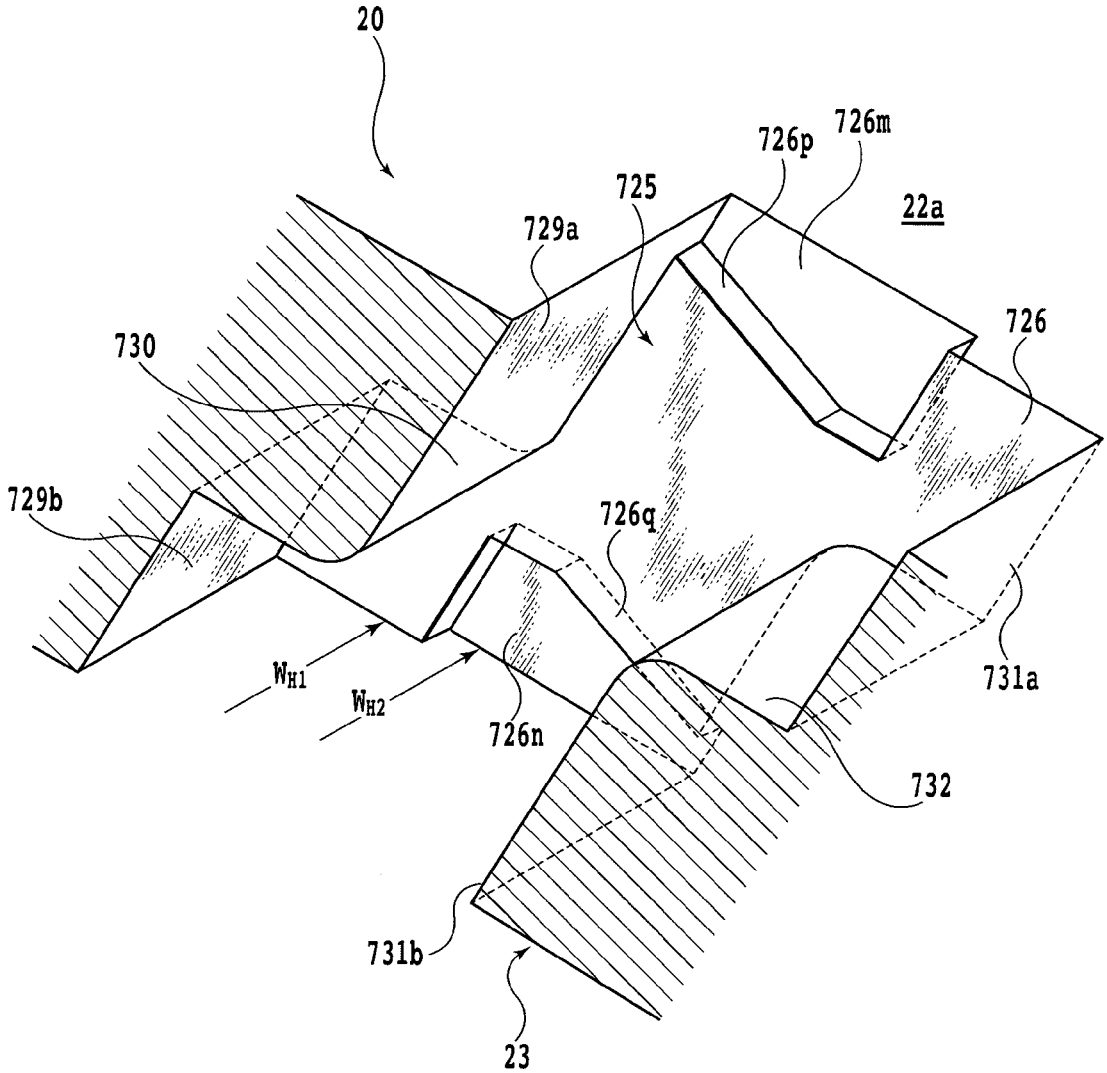
FIG. 22 is a partially cross sectional, perspective view showing the socket body of the IC socket shown in FIG. 20, the socket body showing a contact accommodating chamber, in which the contact is not mounted.

Subsequently, a seventh embodiment will be described with reference to FIGS. 19 to 22. FIG. 19 is an exploded, perspective view showing a contact according to the seventh embodiment of the invention and FIG. 20 is a partially cross sectional view showing a state, in which the contact shown in FIG. 19 is mounted to a socket body of an IC socket and two contact objects are not mounted. FIG. 21 is a partially cross sectional view being similar to FIG. 20 and illustrating an operation, in which a contact is mounted in a contact accommodating chamber of an IC socket. FIG. 22 is a partially cross sectional, perspective view showing a contact accommodating chamber of the socket body of the IC socket shown in FIG. 20, in which the contact is not mounted.

The embodiment is a modification, in which the contact is composed of two contact members in the same manner as in the sixth embodiment and the contact is improved in spring characteristic. In the embodiment, the contact accommodating chamber is different in structure from that in the sixth embodiment by reason of the structure of the contact.

First, an explanation will be given to a contact 740 according to the embodiment. As described above, the contact 740 according to the embodiment includes two contact members, that is, a first contact member 750 and a second contact member 760. Also, in the embodiment, the two contact members 750, 760 are not limitative but are preferably quite the same in structure.

The two contact members 750, 760, which constitute the contact 740, are punched as elongate band-shaped bodies having a predetermined shape from a conductive, metallic sheet such as beryllium copper (BeCu) and formed by bending the band-shaped bodies. The first and second contact members 750, 760 are caused to overlap each other as shown in FIG. 19 and formed into a shape, which is contactable up and down with two contact objects, in the same manner as the contact 40 in the first embodiment. The contact 740 according to the embodiment is also substantially Z-shaped as viewed laterally. The contact 740 formed by overlapping the two contact members 750, 760 is formed to be the same in height, width and depth as the contact 40 in the first embodiment.

Also, in the embodiment, since the two contact members 750, 760 are quite the same in structure, the second contact member 760 will be described herein and an explanation for the first contact member 750 is omitted. In addition, the first contact member 750 is understood by reading the explanation for the second contact member 760 with the reference numeral 760 replaced by 750.

The second contact member 760 includes a first flat arm portion 761 having a contact portion 761*a* at a tip end thereof being a free end, an arcuate projection 762, and a second flat arm portion 763 having a contact portion 765 at a tip end thereof being a free end. The first arm portion 761 and the second arm portion 763 are folded back with an arcuate projection 762 therebetween, which is arcuate in cross section and has a circle of curvature, of which an inscribing circle inscribing the arc has a radius R of curvature, whereby the portions are connected to each other to assume a substantially V-shaped configuration. Also, in the embodiment, a connected structure of the first arm portion 761 and the second arm portion 763 with the arcuate projection 762 therebetween is the same as a connected structure of the first arm portion 41 and the coupling portion 43 with the first arcuate projection 42 therebetween in the first embodiment.

The second arm portion 763 in the embodiment is provided substantially centrally thereof with an engagement piece 763*e* and an engagement window portion 763*f* and formed on both sides of a tip end being a free end with a pair of stop members 766*a*, 766*b*, which project outward in a width direction.

The engagement window portion 763*f* is a rectangular-shaped opening extending in a longitudinal direction of the second arm portion 763 to extend through the second arm portion 763. As shown in FIG. 19, the engagement piece 763*e* is supported in a cantilever-like manner on a side of the engagement window portion 763*f* toward the arcuate projection 762 to extend in the engagement window portion 763*f*. A free end 763*e*1 of the engagement piece 763*e* is preferably formed to project in a direction away from the first arm portion 761 as opposed thereto and to make its neighborhood parallel to the second arm portion 763 but this is not limitative. A length from a supported end 763*e*2 of the engagement piece 763*e* to the free end 763*e*1 thereof is a little smaller than half the length of the engagement window portion 763*f* in a longitudinal direction and the engagement piece 763*e* preferably extends in the engagement window portion 763*f*. The engagement piece 763*e* is also preferably cut out from the second arm portion 763 to be formed.

By providing the engagement piece 763*e* and the engagement window portion 763*f* on the second arm portion 763, the first and second contact members 750, 760 are prevented from moving in a mutually intersecting direction when being caused to overlap each other as shown in FIG. 20.

Also, the contact portion 765 provided at the free end of the second arm portion 763 is formed to be arcuate in cross section, the arcuate contact portion 765 being formed at a tip end of the second arm portion 763 in a manner to project in a direction away from the contact portion 761*a* as opposed thereto.

The arcuate projection 762 of the second contact member 760 is formed so that its circle of curvature contacts with a horizontal step portion 732 at a contact point E disposed on the circle when the contact 740 is mounted in the contact accommodating chamber 725 as shown in FIG. 20. That is, the arcuate projection 762 of the second contact member 760 is formed to project outward from the first arm portion 761.

The first arm portion 761 and the second arm portion 763 are formed connectedly with the arcuate projection 762 therebetween whereby the first arm portion 761 and the second arm portion 763 can be elastically deformed about a center H of curvature of the arcuate projection 762. When the contact 740 is mounted in the contact accommodating chamber 725 as shown in FIG. 21, a reaction force F is applied to the contact portion 765 of the second arm portion 763 from the first contact member 750 when an upwardly directed contact force A is exerted on the contact portion 761*a* of the first arm portion 761. Accordingly, the first and second arm portions 761, 763 are elastically deformed whereby the second contact member 760 is improved in spring characteristic in the same manner as in the sixth embodiment as compared with that of the first embodiment. This can also be said with respect to the first contact member 750.

As described above, in the embodiment, the pair of stop members 766*a*, 766*b* is formed on both sides of the tip end of the second arm portion 763 to project outward in a width direction. The pair of stop members 766*a*, 766*b* including the contact portion 765 is formed on the both sides of the tip end of the second arm portion 763 to project outward in a width direction as shown in FIG. 19.

As shown in FIG. 19, $W_{C4}$ indicates a width of that portion of the second arm portion 763 of the contact 740, on which the stop members 766*a*, 766*b* are not formed, in the embodiment and $W_{C5}$ indicates a width of that portion, on which the stop members 766*a*, 766*b* are formed. As described above, since the pair of stop members 766*a*, 766*b* is formed to project from both sides of the second arm portion 763, the width $W_{C5}$ of that portion, on which the pair of stop members 766*a*, 766*b* is formed, is larger than $W_{C4}$. In addition, the width $W_{C4}$ is indicated as a width of the contact 740 and substantially the same as a width of the first and second arm portions 761, 763. Also, the width $W_{C4}$ may be the same as or different from a width of the contact 40 in the first embodiment.

As described above, the contact 740 in the embodiment is formed by having the first and second contact members 750, 760 overlapping each other as shown in FIG. 20. As described later, however, in the embodiment, the contact 740 is not beforehand formed and then mounted in the contact accommodating chamber 725 unlike the sixth embodiment.

Subsequently, the contact accommodating chamber 725 will be described.

The contact accommodating chamber 725 in the embodiment extends through the socket body 20 and is defined by four side walls, and side walls opposed to each other on the left and right in FIG. 20, out of the four side walls are the same as those in the first and second embodiments. That is, the side walls, respectively, opposed to each other on the left and right in FIG. 20 include first upper and lower inclined side walls 729*a*, 729*b*, a first horizontal step portion 730, second upper and lower inclined side walls 731*a*, 731*b*, and a second horizontal step portion 732.

The pair of side walls (only one 726 of the side walls is shown in the figure) opposed to each other perpendicular to the plane of the figure in FIG. 20, out of the four side walls is different in structure from those in the first to sixth embodiments. In the embodiment, it is necessary to accommodate two pairs of stop members, respectively, provided on the two contact members 750, 760, which constitute the contact 740. Accordingly, in the embodiment, first and second stop member accommodating recesses (only 726*m*, 726*n* formed on one 726 of the side walls are shown in the figure) are provided in pairs on a pair of side walls opposed to each other perpendicular to the plane of the figure in FIG. 20.

Since the pair of side walls, on which the first and second stop member accommodating recesses (referred simply below to as "accommodating recesses") are formed, is the same in structure, one 726 of the side walls shown in the figure will be described in detail and an explanation for the structure of the other of side walls is omitted.

Formed on the side wall 726 are the first and second accommodating recesses 726*m*, 726*n*, in which corresponding stop members 756*a*, 766*a* out of the two pairs of stop members 756*a*, 756*b* and 766*a*, 766*b* of the contact 740 are respectively accommodated.

The first accommodating recesses 726*m* in the embodiment are formed to extend from a side toward the bottom surface 22*a* of the recess 22 for IC package placement along the first upper inclined side wall 729*a*, which defines the contact accommodating chamber 725, to be appropriate in height, width and depth. Likewise, the second accommodating recesses 726*n* are formed to extend from a side toward the bottom surface 23 of the socket body 20 along the second lower inclined side wall 731*b* to be the same in length, width and depth as the first accommodating recesses 726*m*. Accordingly, the first and second accommodating recesses 726*m*, 726*n* are formed to be arranged point-symmetrically up and down as shown in FIG. 20. First step portions 726*p* are formed between the first accommodating recesses 726*m* and the side walls 726 and second step portions 726*q* are formed between the second accommodating recesses 726*n* and the side walls 726.

$W_{H3}$ indicates a distance between the pair of side walls (726) of the contact accommodating chamber 725. Further, $W_{H4}$ indicates a distance between the first accommodating recesses (726*m*) (or the second accommodating recesses 726*n*) formed in pair. At this time, a width of the contact 740 and a distance between the pair of side walls 226, 227 of the contact accommodating chamber 225 are set to meet $W_{H4}>W_{C5}>W_{H3}>W_{C4}$.

A first arm portion 751 of the first contact member 750 is supported on the first upper inclined side wall 729*a*, which defines the contact accommodating chamber 725, when the contact 740 in the embodiment is mounted in the contact accommodating chamber 725 as shown in FIG. 20. Also, the arcuate projection 752 of the first contact member 750 is supported on the first horizontal step portion 730, which defines the contact accommodating chamber 725. Likewise, the arcuate projection 762 of the second contact member 760 is supported on the second horizontal step portion 732 and the first arm portion 761 of the second contact member 760 is supported on the second lower inclined side wall 731*b*.

Also, the engagement piece 763*e* of the second contact member 760 is entered an engagement window portion 753*f* of the first contact member 750 in a manner to be opposed to an engagement piece 753*e* of the first contact member 750. Likewise, the engagement piece 753*e* of the first contact member 750 is entered the engagement window portion 763*f* of the second contact member 760. At this time, the engagement piece 753*e* of the first contact member 750 and the engagement piece 763*e* of the second contact member 760, which are opposed to each other, are preferably entered the corresponding engagement window portions 753*f*, 763*f* so that respective free ends 753*e*1, 763*e*1 can abut against each other. In the embodiment, the engagement pieces 753*e*, 763*e* together with the engagement window portions 753*f*, 763*f* are provided on the respective, second arm portions 753, 763 of the first and second contact members 750, 760 in this manner. However, this structure is not limitative but only the engagement pieces 753*e*, 763*e* may be cut out from the respective, second arm portions 753, 763 of the first and second contact members 750, 760.

Further, a contact portion 755 of the first contact member 750 contacts with the arcuate projection 762 of the second contact member 760 and the contact portion 765 of the second contact member 760 contacts with the arcuate projection 752 of the first contact member 750. Of course, the pair of stop members 756*a*, 756*b* of the first contact member 750 are accommodated in the pair of first accommodating recesses (726*m*) and the pair of stop members 766*a*, 766*b* of the second contact member 760 are accommodated in the pair of second accommodating recesses (726*n*).

The contact 740 and the contact accommodating chamber 725 are structured in this manner whereby the contact 740 does not come off the contact accommodating chamber 725 in a vertical direction in FIG. 20 even when a little shift occurs in the vertical direction.

As described above, in the embodiment, the contact 740 cannot be mounted in the contact accommodating chamber 725 after the first and second contact members 750, 760 are beforehand combined each other as in the sixth embodiment to form the contact 740. An operation of mounting the contact 740 in the contact accommodating chamber 725 in the embodiment will be described with reference to FIG. 21.

First, the second contact member 760 is arranged in a predetermined position within the contact accommodating chamber 725. Specifically, the second contact member 760 is inserted into the contact accommodating chamber 725 from under. Succeedingly, as shown in FIG. 21, the second contact member 760 is mounted in the contact accommodating chamber 725 so that the arcuate projection 762 of the second contact member 760 is put on the second horizontal step portion 732, which defines the contact accommodating chamber 725.

Subsequently, the first contact member 750 is inserted into the contact accommodating chamber 725 from above with the arcuate projection 752 of the first contact member 750 positioned below. At this time, since the second arm portion 751 of the first contact member 750 and the second arm portion 761 of the second contact member 760 can be deformed relative to each other, the first contact member 750 can be readily inserted. When the arcuate projection 752 of the first contact member 750 reaches the first horizontal step portion 730, which defines the contact accommodating chamber, mounting of the contact 740 is finished.

In addition, while the first and second independent accommodating recesses (726*m*, 726*n*) are provided on the pair of side walls opposed to each other perpendicular to the plane of the figure in FIG. 20, they may be contiguous as in the third embodiment.

The contact 740 and the contact accommodating chamber 725 in the embodiment are structured as described above whereby the same function and effect as those in the first embodiment are produced and the contact 740 is simply mounted and excellent in spring characteristic in the same manner as in the sixth embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A contact which is substantially Z-shaped as viewed laterally and above and below which two contact objects are present, comprising:

a first flat arm portion having a first contact portion at a tip end thereof;

a first arcuate projection;

a flat coupling portion;

a second arcuate projection; and a second flat arm portion having a second contact portion at a tip end thereof, wherein the first arm portion and the coupling portion are folded back with the first arcuate projection therebetween and are connected to each other to assume a substantially V-shaped configuration, the coupling portion and the second arm portion are folded back with the second arcuate projection therebetween and are connected to each other to assume a substantially V-shaped configuration, the first arcuate projection is disposed below the first arm portion and outside an extension of the first arm portion, and the second arcuate projection is disposed above the second arm portion and outside an extension of the second arm portion.

2. The contact as claimed in claim 1, wherein a pair of stop members are formed on both sides of the flat coupling portion to project outward.

3. The contact as claimed in claim 2, wherein a pair of stop members are formed on the first arcuate projection or the second arcuate projection to project further outward.

4. The contact as claimed in claim 1, wherein the first and second arm portions are provided with turned-up pieces, free ends of which are cut and turned up toward the coupling portion.

5. The contact as claimed in claim 1, wherein a center of curvature of a circle of curvature of the first arcuate projection is disposed outside the extension of the first arm portion, and a center of curvature of a circle of curvature of the second arcuate projection is disposed outside the extension of the second arm portion.

6. The contact as claimed in claim 5, wherein a pair of stop members are formed on both sides of the flat coupling portion to project outward.

7. The contact as claimed in claim 6, wherein a pair of stop members are formed further on the first arcuate projection or the second arcuate projection to project outward.

8. The contact as claimed in claim 1, wherein the first and second arcuate projections are arranged to be point-symmetrical with respect to an axis of the contact.

9. The contact as claimed in claim 8, wherein a center of curvature of a circle of curvature of the first arcuate projection is disposed outside the extension of the first arm portion, and a center of curvature of a circle of curvature of the second arcuate projection is disposed outside the extension of the second arm portion.

10. The contact as claimed in claim 9, wherein a pair of stop members are formed on both sides of the flat coupling portion to project outward.

11. The contact as claimed in claim 10, wherein a pair of stop members are formed further on the first arcuate projection or the second arcuate projection to project outward.

12. The contact as claimed in claim 8, wherein a pair of stop members are formed on both sides of the flat coupling portion to project outward.

13. The contact as claimed in claim 12, wherein a pair of stop members are formed further on the first arcuate projection or the second arcuate projection to project outward.

14. A contact, above and below which two contact objects are present, being formed by combining first and second contact members, each of contact members including a first flat arm portion having a contact portion at a tip end thereof, an arcuate projection, and a second flat arm portion having a contact portion at a tip end thereof;

wherein the first arm portion and the second arm portion of the respective contact members are folded back with the arcuate projection therebetween and are connected to each other to assume a substantially V-shaped configuration, when the first and second contact members are combined to form the contact, the contact is substantially Z-shaped as viewed laterally, and the arcuate projection of the first contact member is disposed below the first arm portion of the first contact member and outside an extension of the first arm portion, and the arcuate projection of the second contact member is disposed above the first arm portion of the second contact member and outside an extension of the first arm portion.

15. The contact as claimed in claim 14, wherein a pair of stop members are formed on both sides of a tip end of the second arm portion of each of the contact members to project outward.

16. An IC socket comprising:

a plurality of contacts, each being substantially Z-shaped as viewed laterally, each contacting with two contact objects above and below there, each including a first flat arm portion having a first contact portion at a tip end thereof, a first arcuate projection, a flat coupling portion, a second arcuate projection, and a second flat arm portion having a second contact portion at a tip end thereof;

wherein the first arm portion and the coupling portion are folded back with the first arcuate projection therebetween and are connected to each other to assume a substantially V-shaped configuration, the coupling portion and the second arm portion are folded back with the second arcuate projection therebetween and are connected to each other to assume a substantially V-shaped configuration, the first arcuate projection is disposed below the first arm portion and outside an extension of the first arm portion, and the second arcuate projection is disposed above the second arm portion and outside an extension n of the second arm portion, and a socket body having a plurality of contact accommodating chambers, each of which accommodates therein the contact, and having mounting thereto two contact objects, which contact with the first and second contact portions of the contact, and wherein the contact accommodating chambers extend through the socket body up and down.

17. The IC socket as claimed in claim 16, wherein a pair of side walls opposed to each other to define the contact accommodating chamber provided on the socket body are formed obliquely and parallel to each other, horizontal step portions are formed midway the respective side walls to differ from each other in height from a bottom surface of the socket body and in parallel to the bottom surface, and the horizontal step portions support the arcuate projections of the contact.

18. The IC socket as claimed in claim 17, wherein the contact accommodated in the contact accommodating chamber comprises a pair of stop members formed on both sides of a tip end of the second arm portion of each of the contact members to project outward, and accommodating recesses are formed on the remaining pair of side walls, which are opposed to each other to define the contact accommodating chamber, to accommodate stop members provided in pair on the contact.

19. An IC socket comprising at least:

a plurality of contacts, each contacting with two contact objects above and below, each being formed by combining first and second contact members, each contact member including a first flat arm portion having a contact portion at a tip end thereof, an arcuate projection, and a second flat arm portion having a contact portion at a tip end thereof, in which the first arm portion and the second arm portion of the respective contact members are folded back with the arcuate projection therebetween and are connected to each other to assume a substantially V-shaped configuration, when the first and second contact members are combined to form the contact, they are substantially Z-shaped as viewed laterally, and in which the arcuate projection of the first contact member is disposed below the first arm portion of the first contact member and outside an extension of the first arm portion, and the arcuate projection of the second contact member is disposed above the first arm portion of the second contact member and outside an extension of the first arm portion, and a socket body having a plurality of contact accommodating chambers, each of which accommodates therein the contact and mounting thereto two contact objects, which contact with the first and second contact portions of the contact;

wherein the contact accommodating chambers extend through the socket body up and down.

20. An IC socket as claimed in claim 19, wherein a pair of side walls opposed to each other to define the contact accommodating chamber provided on the socket body are formed obliquely and parallel to each other, horizontal step portions are formed midway the respective side walls to differ from each other in height from a bottom surface of the socket body and in parallel to the bottom surface, and the horizontal step portions support the arcuate projections of the contact.

21. An IC socket as claimed in claim 20, wherein the contact accommodated in the contact accommodating chamber comprises a pair of stop members formed on both sides of a tip end of the second arm portion of each of the contact members to project outward, and accommodating recesses are formed on the remaining pair of side walls, which are opposed to each other to define the contact accommodating chamber, to accommodate stop members provided in pair on the contact.

* * * * *